US007621227B2

(12) United States Patent
Sterr

(10) Patent No.: US 7,621,227 B2
(45) Date of Patent: Nov. 24, 2009

(54) GRANULAR BIOMASS BURNING HEATING SYSTEM

(76) Inventor: Kevin K. Sterr, W.2579 Zion Church Rd., Mayville, WI (US) 53050

( * ) Notice: Subject to any disclaimer, the term of this patent is extended or adjusted under 35 U.S.C. 154(b) by 683 days.

(21) Appl. No.: 11/303,381

(22) Filed: Dec. 16, 2005

(65) Prior Publication Data

US 2007/0137538 A1 Jun. 21, 2007

(51) Int. Cl.
*F23M 5/08* (2006.01)
*F22B 9/08* (2006.01)
*F23B 90/00* (2006.01)

(52) U.S. Cl. ..... 110/297; 110/108; 110/165 R; 110/341; 122/391

(58) Field of Classification Search ..... 110/101 R, 110/108, 109, 110, 114, 341; 122/405, 392, 122/390, 391; 431/258
See application file for complete search history.

(56) References Cited

U.S. PATENT DOCUMENTS

| | | | | |
|---|---|---|---|---|
| 316,673 | A | | 4/1885 | Stuart |
| 770,786 | A | | 9/1904 | Strouse |
| 1,786,150 | A | | 12/1930 | Cutler |
| 1,952,227 | A | | 3/1934 | Adams |
| 2,276,659 | A | | 3/1942 | Kreisinger |
| 2,364,698 | A | | 12/1944 | Davin |
| 2,978,999 | A | | 4/1961 | Smith |
| 3,508,506 | A | | 4/1970 | Bishop |
| 3,618,299 | A | | 11/1971 | Vincent |
| 3,620,509 | A | | 11/1971 | Roman |
| 3,693,326 | A | | 9/1972 | Deane |
| 3,760,567 | A | | 9/1973 | Stalker |
| 4,017,254 | A | | 4/1977 | Jones |
| 4,168,958 | A | | 9/1979 | Hartman |
| 4,184,455 | A | | 1/1980 | Talmud et al. |
| 4,240,377 | A | | 12/1980 | Johnson |
| 4,278,034 | A | | 7/1981 | Reale |
| 4,286,527 | A | | 9/1981 | Robinson |
| 4,334,485 | A | | 6/1982 | Guida |
| 4,341,232 | A | * | 7/1982 | Maton ..... 134/107 |
| 4,419,965 | A | | 12/1983 | Garcia-Mallol |
| 4,426,937 | A | | 1/1984 | Sietmann et al. |
| 4,454,827 | A | | 6/1984 | Smith et al. |
| 4,545,309 | A | | 10/1985 | Comtois |
| 4,548,194 | A | * | 10/1985 | Schafer et al. ..... 126/110 R |
| 4,549,490 | A | | 10/1985 | Wetzel et al. |
| 4,565,184 | A | | 1/1986 | Collins et al. |
| 4,583,495 | A | | 4/1986 | Hill et al. |

(Continued)

*Primary Examiner*—Kenneth B Rinehart
*Assistant Examiner*—David J Laux
(74) *Attorney, Agent, or Firm*—John K. McCormick

(57) ABSTRACT

A granular biomass burning furnace for use with any appropriate granular biomass, such as grains, cherry pits, etc. The furnace includes a three stage heat exchanger, a fuel injector, a fuel stirrer, an ash ejector, a wash down system, a three stage air inducer, a fuel igniter, and supporting components. The unit includes a computer controller which controls all aspects of the operation of the unit based on information from sensors located throughout the unit. The unit includes a smart logic thermal controller to adjust the output heat of the unit via a variable speed air inducer. The three stage heat exchanger system includes a spiral water jacket surrounding the burn pot, a plurality of heat exchanger baffles in the unit, and a fine finned heat exchanger at the top of the unit. The air inducer provides air to the burn pot from three directions to promote complete combustion.

16 Claims, 15 Drawing Sheets

U.S. PATENT DOCUMENTS

| | | | | |
|---|---|---|---|---|
| 4,593,629 | A | | 6/1986 | Pederson et al. |
| 4,619,209 | A | | 10/1986 | Traeger et al. |
| 4,646,637 | A | | 3/1987 | Cloots |
| 4,646,662 | A | | 3/1987 | McGee et al. |
| 4,655,146 | A | | 4/1987 | Lemelson |
| 4,738,205 | A | | 4/1988 | Beirle et al. |
| 4,782,765 | A | | 11/1988 | Miller et al. |
| 4,782,767 | A | | 11/1988 | Stoner |
| 4,785,744 | A | | 11/1988 | Fontaine |
| 4,896,508 | A | | 1/1990 | Reinke, Jr. |
| 4,922,889 | A | | 5/1990 | Nuesmeyer |
| 4,947,769 | A | | 8/1990 | Whitfield |
| 4,989,521 | A | | 2/1991 | Traeger et al. |
| 5,000,100 | A | | 3/1991 | Mendive et al. |
| 5,001,993 | A | | 3/1991 | Gramlow |
| 5,105,797 | A | | 4/1992 | Gulutzen et al. |
| 5,133,266 | A | | 7/1992 | Cullen |
| 5,151,000 | A | | 9/1992 | Geraghty et al. |
| 5,243,963 | A | | 9/1993 | Riener |
| 5,259,123 | A | | 11/1993 | Garcia-Mallol |
| 5,285,738 | A | | 2/1994 | Cullen |
| 5,308,385 | A | | 5/1994 | Winn |
| 5,331,943 | A | | 7/1994 | Ko |
| 5,343,819 | A | | 9/1994 | Charest |
| 5,375,540 | A | | 12/1994 | Verrecchia et al. |
| 5,429,110 | A | | 7/1995 | Burke et al. |
| 5,617,841 | A | | 4/1997 | Whitfield et al. |
| 5,678,494 | A | | 10/1997 | Ulrich |
| 5,873,356 | A | * | 2/1999 | Vossler et al. ..... 126/110 E |
| 5,893,358 | A | | 4/1999 | Whitfield |
| 6,024,032 | A | * | 2/2000 | Sharpe ..... 110/342 |
| 6,223,737 | B1 | | 5/2001 | Buckner |
| 6,336,449 | B1 | * | 1/2002 | Drisdelle et al. ..... 126/73 |
| 7,318,431 | B1 | * | 1/2008 | Holtan et al. ..... 126/7 |
| 2004/0200394 | A1 | | 10/2004 | Krumrei |

* cited by examiner

*LOW BURN SEQUENCING PROTOCOL*

INTERMEDIATE BURN SEQUENCING PROTOCOL

GRANULAR BIOMASS BURNING HEATING SYSTEM

BACKGROUND OF THE INVENTION

The present invention relates to a granular biomass burning heating system. Any type of granular biomass can be used as fuel. Grains, such as corn and wheat, have become popular fuel sources for furnaces and stoves. Various stoves and furnaces of a type to burn such materials are known.

In any type of solid fuel burning system, regardless of the type of fuel being used, it is desired to increase the efficiency of the system so that the amount of heat produced and utilized by the system is relatively high. It is further desired to decrease the lag time between unit start up and when heat is evident to the user. Further, some known biomass fuel furnaces have problems with incomplete burning of the fuel. Therefore it is desirable to provide a biomass furnace which provides for complete burning of the fuel.

One of the problems associated with some grain burning heating systems is back burning. Many granular biomass burning heating systems include an auger-type fuel feed. Back burning occurs when fuel located in this auger begins to burn before it is introduced to the burn pot. It is desirable to provide a granular biomass burning heating system with a fuel feed designed to prevent back burning.

Some known biomass furnaces have problems associated with the controls. For example, the heat of the furnace can be difficult to control. It is therefore desirable to provide a user friendly furnace, which utilizes a computer control unit to function on its own with very little human intervention. It is further desirable to provide a system which utilizes a smart logic thermal controller to reduce the human intervention necessary to keep the output of the furnace at a consistent or desirable temperature.

Additional problems included fly ash build up in previous furnaces. Fly ash can decrease the efficiency of the system, so it is desirable to include a way to remove the build up of ash from a biomass furnace. Additionally, incomplete combustion can clog the system by creating clinkers, or hardened lumps of unburned material, and can also decrease efficiency. Therefore it is desirable provide a biomass furnace which removes clinkers and also promotes complete combustion.

Although many designs for granular biomass burning heating systems have been considered, improved designs are continually being sought to improve the technology. It is an object to the present invention to provide a novel granular biomass burning heating system.

SUMMARY OF THE INVENTION

The present invention provides an improved granular biomass burning heating system. The apparatus includes a three stage heat exchanger, wherein the heat exchanger stages are connected in parallel relation to each other.

The apparatus may further include a linear fuel infeed system including a self closing door to minimize back burning. The apparatus may also include a venturi design to direct smoke and fire away from the self closing door when the unit is in operation.

The apparatus may further include an air inducement system by which air is supplied to the burn pot from the side, center, and bottom of the burn pot.

The apparatus may further include a wash down system which includes a water supply pump, a water filter, a baffled water sediment tank, and a rotatable shaft with a plurality of holes formed there to remove ash and other debris from the furnace. The apparatus may recycle water and cleaning solution within the process.

The invention may include a computer controller which automatically controls features of the furnace to automatically operate the system.

The invention may include a smart thermostat and a variable speed air inducer fan. The unit may utilize the smart thermostat to determine when and how long to use the high burn status before selecting the intermediate burn, low burn, burnout, or wash down status. This allows the unit to adjust itself to use the minimum amount of fuel to achieve maximum heating results. The computer chooses the heat status required for to further increase efficiency of the unit. The computer also decreases the lag time between the call for heat and actual heat. This units starts at high burn to generate maximum heat initially and through the process the unit turns down heat output when necessary to limit wasted heat.

The invention may further include a plurality of sensors connected to the computer controller such that the system is controlled based on input from the plurality of sensors.

Additional objects and advantages of the invention will be set forth in the following description, or may be learned through practice of the invention.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
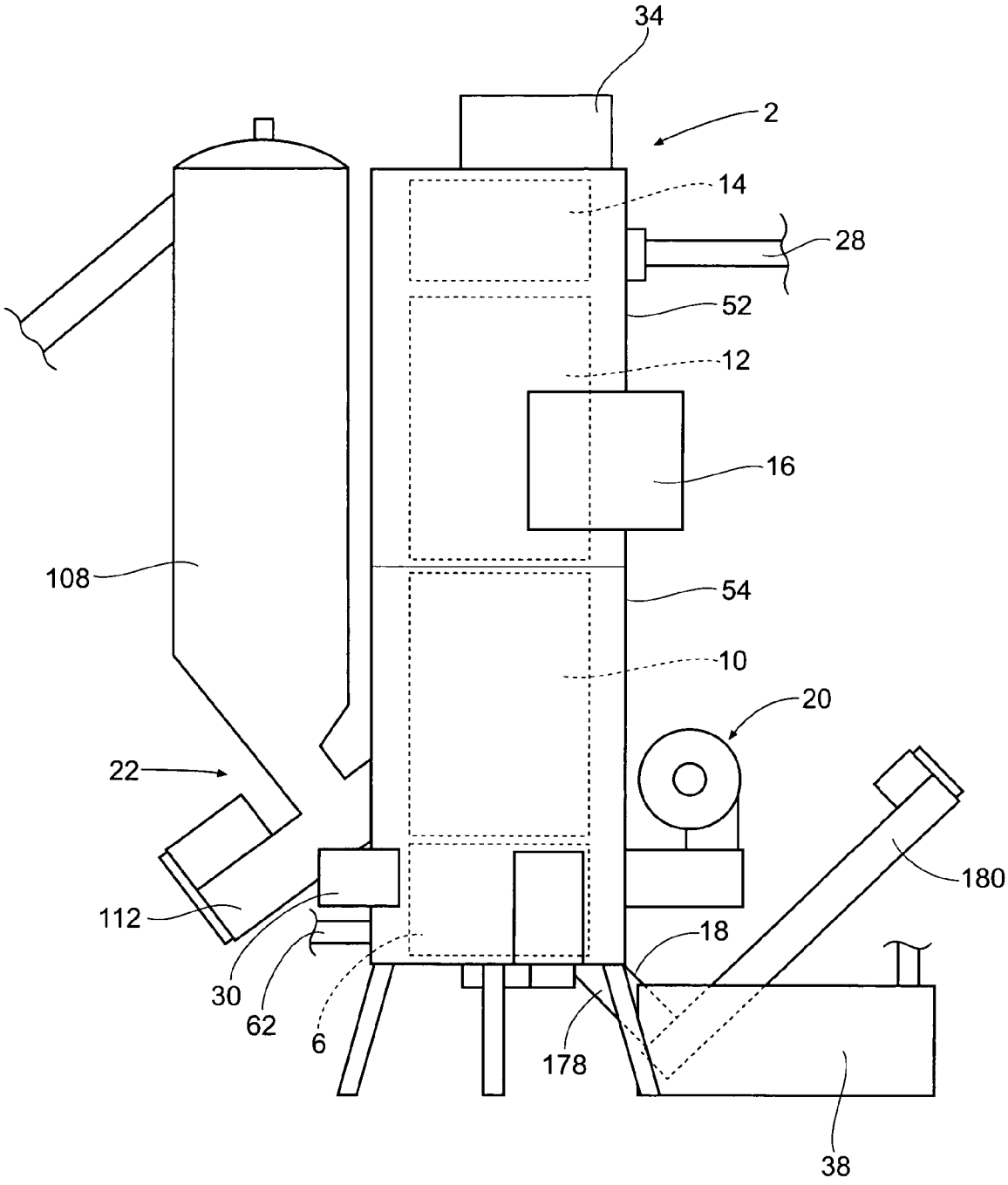
FIG. 1 is a simplified side plan view of the furnace of the present invention.

FIG. 1 shows the furnace 2 of the presenting invention in a very simplified form. The furnace 2 has a lower portion 54 and an upper portion 52. Within the lower portion 54 of the furnace 2 is a burn pot 6 and a first stage heat exchanger 10. A second stage heat exchanger 12 lies in both the lower portion 54 and the upper portion 52 of the furnace. The upper portion 52 of the furnace 2 also includes a third stage heat exchanger 14. The furnace 2 is preferably controlled by a computer 16. A plurality of sensors (shown in FIG. 7) are located throughout the furnace 2 to measure conditions. The data from these sensors is utilized by the computer 16 to run the furnace 2. The furnace 2 includes an ash removal system 18, an air inlet system 20, and a fuel inlet system 22. The furnace 2 is optionally surrounded by an insulated jacket 24.

The furnace 2 is preferably cylindrical in shape. Attached to the furnace 2 is a computer controller 16, an air infeed 20, a fuel infeed 22, a water infeed 62, a water outlet 28, a water pump 30, fuel and ash rotator 32, a washdown pipeshaft motor 34, a wash down and ash removal caseway 36, and a baffled sediment tank 38.

Figure 4:
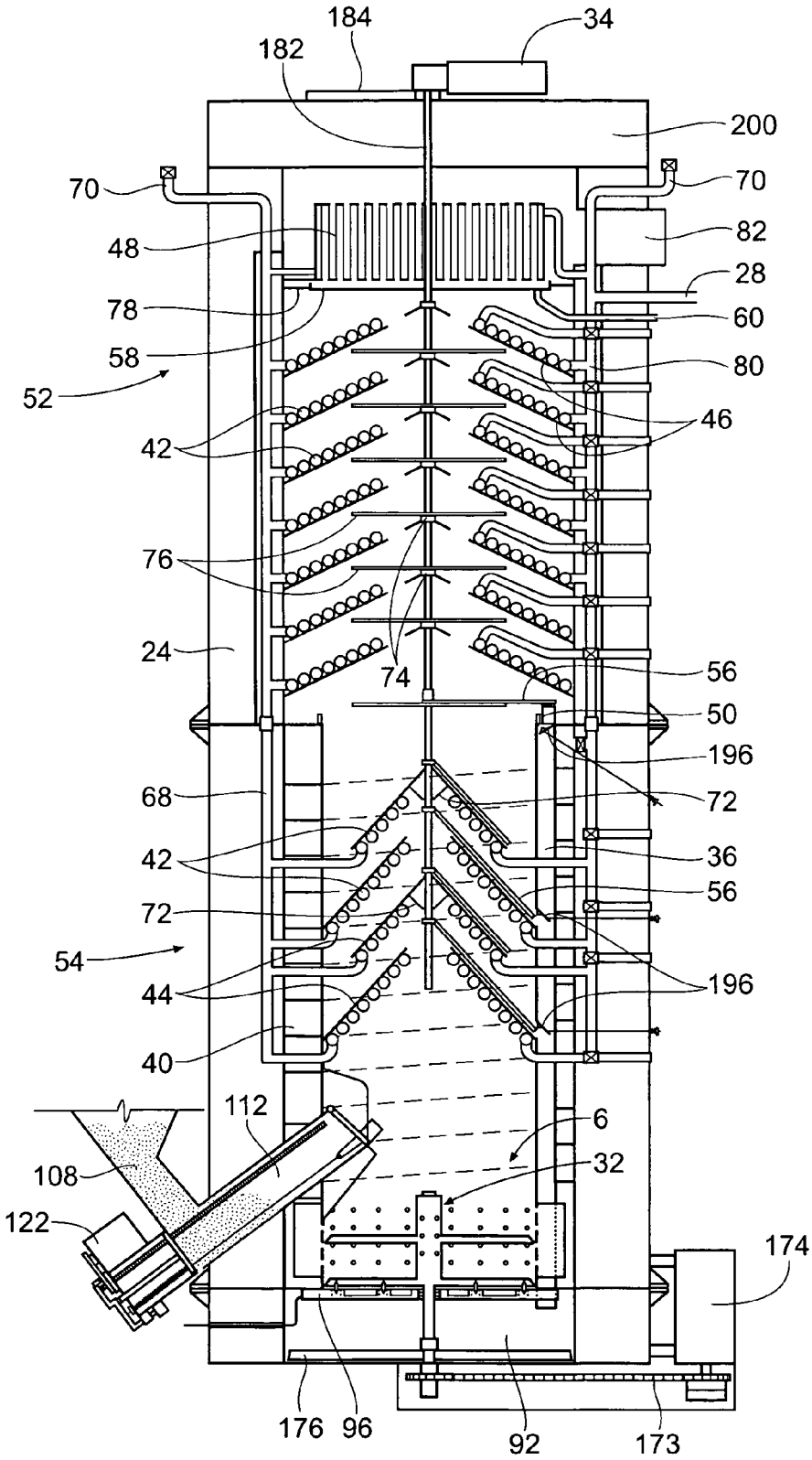
FIG. 4 is an interior view of the furnace of the present invention.

The preferred embodiment of the present invention includes three stages of heat exchangers which can best be seen in FIG. 4. The first stage of the heat exchanger is a spiral shaped water jacket 40 surrounding the burn pot 6. The second stage is a set of heat exchanger heli-coils 42 which are strapped to ash funnels 44 or heli-coils 42 supported by tripod legs 46 located in the furnace 2. The third stage is a fine finned heat exchanger 48 open at the bottom and baffled at the top. The third stage heat exchanger is located at the top of the furnace 2. The use of a three stage heat exchanger system increases the efficiency of the heat transfer of the system.

The furnace 2 preferably also includes condensation collectors. One bushel of corn at 10 percent moisture produces 5.6 pounds of water. This water can douse the flames if it is not removed from the system. The condensation collectors carry water away from the center of the burn pot 6. The first and third ash funnels 44 can additionally suffice as a condensation collector. The condensation travels along the funnel 44 to the ash caseway 36. In the preferred embodiment, an ash/condensate trough 50 located at the point where the lower portion 54 and upper portion 52 of the furnace 2 connect collects condensation as it travels towards and down the ash caseway 36. An ash wiper 56 associated with the trough 50 pushes the condensation towards the ash caseway 36. A third condensation tray 58 which is cupped upward can be located underneath the fine finned heat exchanger 48 so that water hits the tray 58 and is removed from the system by a pipe 60 which deposits the condensation in the baffled sediment tank 38. It is desirable to remove the condensation from the furnace 2 to increase the efficiency of the furnace 2.

Figure 3:
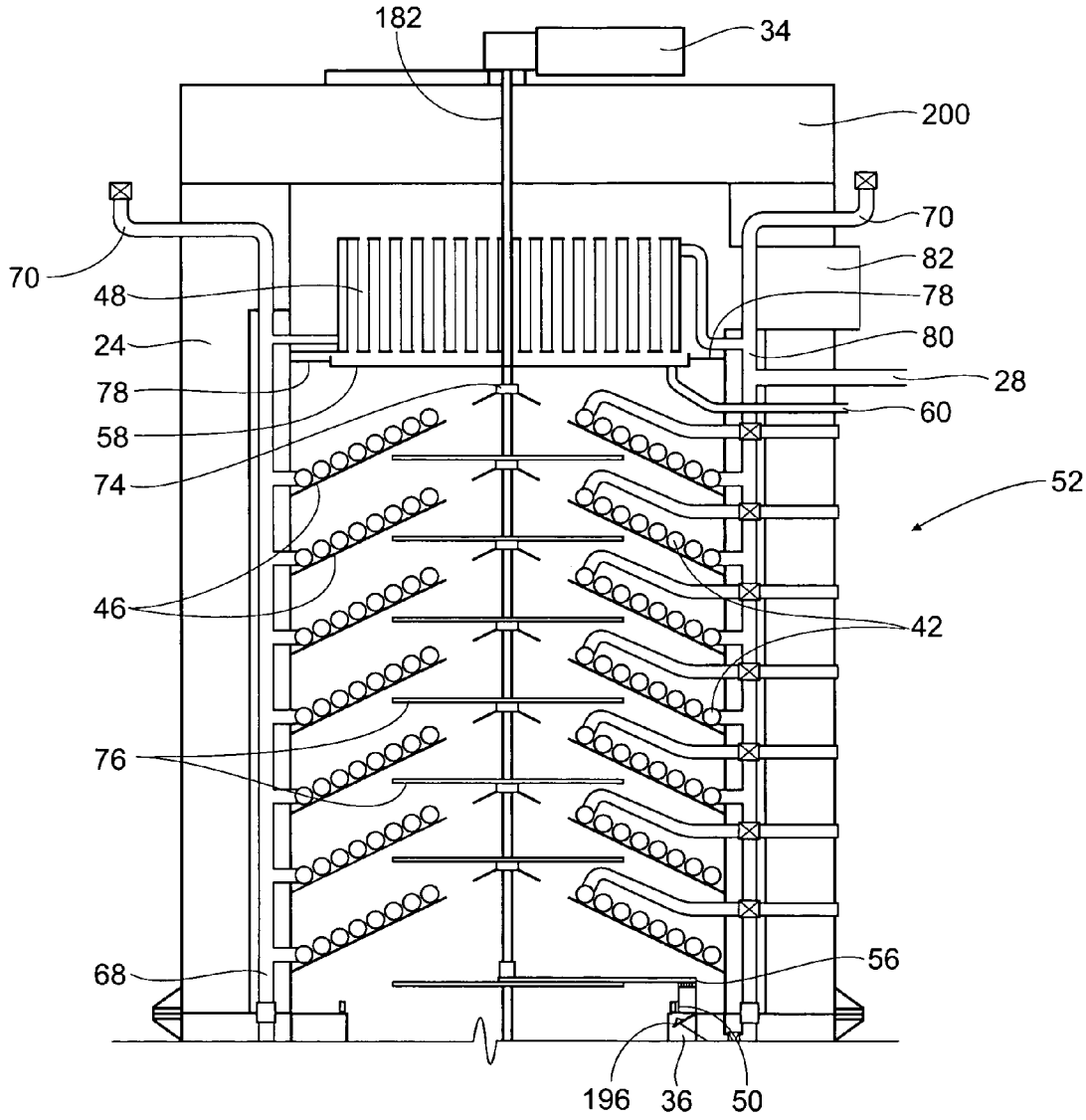
FIG. 3 is an interior view of the top portion of the furnace of the present invention.
Figure 6:
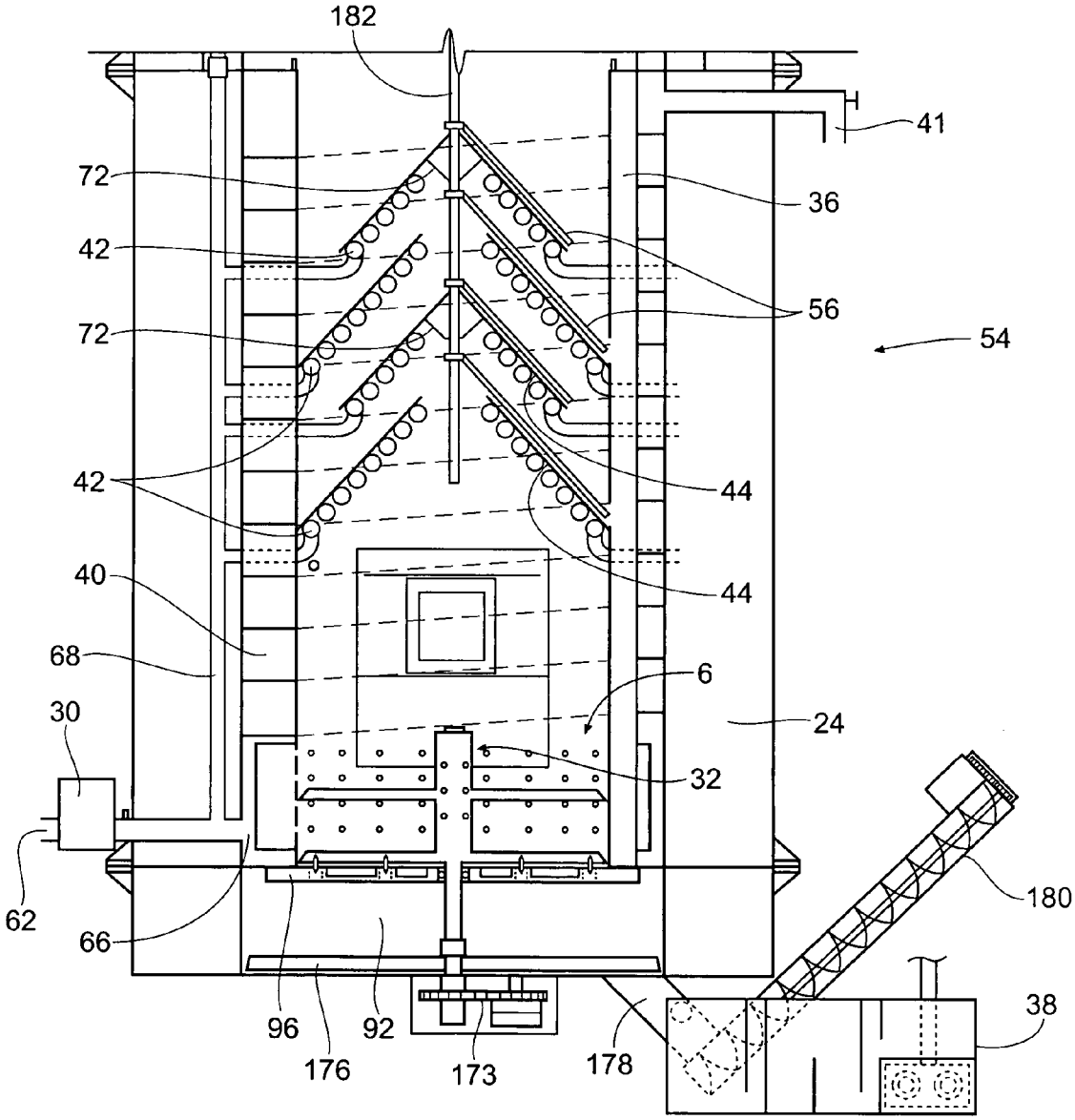
FIG. 6 is an interior view of the bottom portion of the furnace of the present invention showing the water intake system, the ash auger, and the baffled sediment tank.

Each stage of heat exchanger is supplied with water. The water inlet system is shown in FIG. 6. The water is provided to the furnace inlet pipe 62 which is connected to the heating system. It is contemplated that this water may come from a coil within a forced air furnace or heating pipes within the floor of the area to be heated by the furnace (not shown). The furnace inlet pipe 62 serves a water pump 30 which is located outside of the furnace 2, near the bottom of the burn pot 6. A system drain valve is preferably located in the furnace inlet pipe 62 near the water pump 30. The water is pumped into the furnace 2 through the furnace inlet pipe 62. In the preferred embodiment, the furnace inlet pipe 62 splits into a first supply pipe 66 and an inlet manifold 68. The first supply pipe 66 supplies the spiral water jacket 40. The inlet manifold 68 continues up the side of the furnace 2 on the outside of the furnace 2, but underneath the optional insulating jacket 24. The inlet manifold 68 supplies each heat exchanger heli-coil 42. As seen in FIG. 3, near the top of the furnace 2 the inlet manifold 68 supplies the fine finned heat exchanger 48. Through this configuration the heat exchangers are set up in parallel relation to each other such that each heat exchanger stage is provided with fresh heating system water. The inlet manifold 68 continues past the fine finned heat exchanger 48 and exits the optional insulated jacket 24. The inlet manifold 68 ends in an air bleed off valve 70.

This inlet configuration puts the stages of the heat exchanger in parallel rather than in series. Because each stage of the heat exchanger is getting fresh heating system water, rather than water which has been utilized in a previous stage heat exchanger, the efficiency of heat exchange in the system is increased. As discussed above, condensation problems are overcome by condensation collection system. This is because the efficiency of a heat exchanger depends in part on the temperature differential between the two fluids in the system. Water which has been used in a previous stage of the heat exchanger would be warmer than fresh heating system water entering the system, and therefore is able to accept less heat from the air in the furnace 2, resulting less efficient heat exchange. The water flowing through some of the heli-coils 42 may be temperature regulated. In this case, a device would be present which would allow water to heat up in the heli-coils 42 before being allowed to flow out of the heli-coils 42. This improves the efficiency of the system because water which is too cold can cause condensation, which if not properly removed, can douse the fire in the burn pot 6.

The first stage heat exchanger is a spiral water jacket 40. The water jacket 40 is formed on the inner wall of the burn pot 6 and extends around the lower portion 54 of the furnace 2. The water jacket 40 forms a spiral path for the water flowing through the system. A water jacket pressure relief valve 41 is located at the top of the water jacket 40, near the area where the lower portion 54 and the upper portion 52 of the furnace mate.

As seen in FIG. 4, the second stage heat exchanger includes a plurality of heat exchanger heli-coils 42. The preferred embodiment includes eleven heli-coils 42, four lower heli-coils 42 in the lower portion 54 of the furnace 2 and seven upper heli-coils 42 in the upper portion of the furnace 2. However, it is contemplated that any other suitable number of heli-coils 42 could be utilized. Each heli-coil 42 is made of a pipe which is tightly wound, such that the rings of the heli-coils 42 are almost touching. The pipe is wound until it becomes too tight and would kink if further wound, leaving the center portion of the heli-coil 42 open (not shown).

Each of the heli-coils 42 in the lower portion 54 of the furnace 2 are strapped to the bottom side of an ash funnel 44. The ash funnels 44 are attached to the internal wall of the furnace 2. The ash funnels 44 are removable for maintenance of the furnace 2. Each heli-coil 42 is fed from the inlet manifold 68. After the water flows through a heli-coil 42, the water flows to the outlet manifold 80. The lower portion 54 of the furnace 2 also includes heat deflectors 72 attached to the second and fourth sets of ash funnels 44. The heat deflectors 72 have a shape similar to a funnel, and force the air from the furnace 2 to take a less direct path, thus exposing the air to more of the heat exchanger heli-coils 42, which will increase the efficiency of the furnace 2.

The upper portion 52 of the furnace 2 includes several upper heli-coils 42; in the preferred embodiment seven heli-coils 42 are utilized. The upper portion 52 heli-coils 42 are strapped to three tripod legs 46 which rest into recessed notches formed in the furnace 2 inner wall. The tripod legs 46 rise upward toward the washdown rotator shaft sleeve 74. The tripod legs 46 are also attached to washdown rotator sleeve 74. The tripod legs 46 are hingedly attached to the rotator sleeve 74. Each heli-coil 42 is fed from the inlet manifold 68. After the water flows through a heli-coil 42, the water flows to the outlet manifold 80.

A plurality of heat deflecting baffles 76 are also located in the upper portion 52 of the furnace 2. In the preferred embodiment of this invention, seven baffles 76 are disclosed. The baffles 76 are aligned such that each baffle 76 is located just below a heli-coil 42. The configuration of the baffles 76 and heli-coils 42 is such that the air in the furnace 2 does not have a straight path up the height of the furnace 2. Rather, the air will be deflected by the baffle 76 and forced to flow around the baffles 76. In this manner, the hot air from the furnace 2 will have more contact with the heat exchanger heli-coils 42, which will result in more efficient heat transfer.

In the preferred embodiment of the invention, the third stage of the heat exchanger system is a fine finned heat exchanger 48. However, it is contemplated that any other suitable type of heat exchanger could be utilized as a third stage heat exchanger. The fine finned heat exchanger 48 is formed of a pipe which has a diameter which is smaller than the diameter of the heli-coils 42. This pipe is bent to create banks of finned tubes. The fine finned heat exchanger 48 is surrounded around its circumference by a removable shroud 78. This shroud 78 forces the air from the furnace 2 to flow through the fine finned heat exchanger 48, rather than flow around it. Water enters the fine finned heat exchanger 48 from the inlet manifold 68. After the water has flowed through the heat exchanger it flows into the outlet manifold 80. After the air from the furnace 2 flows through the fine finned heat exchanger 48, the air exits the system through a pitched down exhaust 82.

Figure 5:
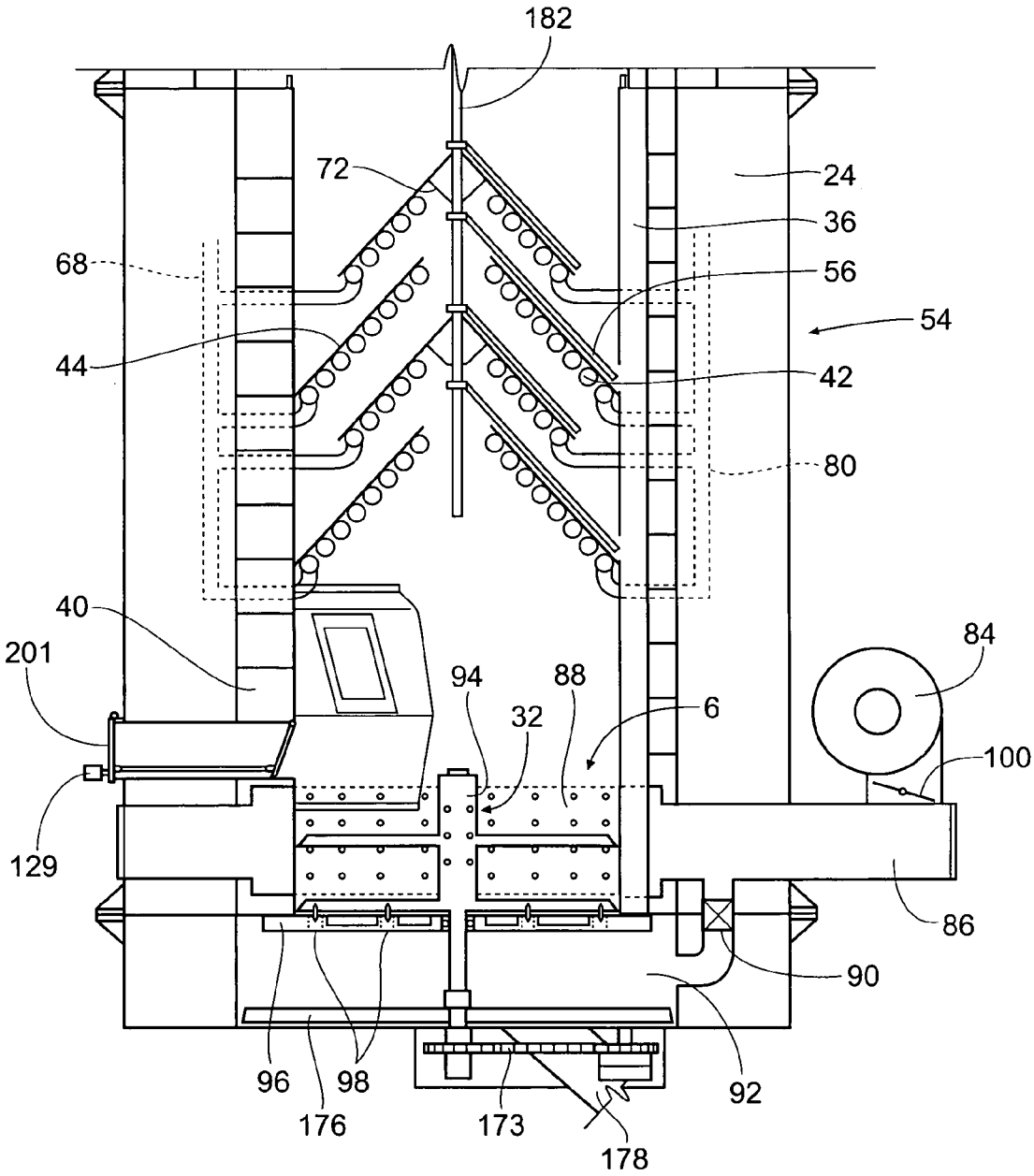
FIG. 5 is an interior view of the bottom portion of the furnace of the present invention showing the air intake system.

FIG. 5 shows the air inlet system 20. The preferred embodiment of the furnace 2 has a three part air inducer system. A variable speed blower 84 is located on the outside of the furnace 2. The blower 84 is connected to an air duct 86. The air duct 86 extends around the diameter of the burn pot 6. The air duct 86 is located near the bottom of the burn pot 6, within the water jacket 40, but below the spirals of the water jacket 40. An air inducing donut 88 is formed with a plurality of air holes such that air is inducted to the burn pot 6 from the outer walls of the burn pot 6. The air inducing donut 88 is immersed in the water jacket 40 and stands up from bottom of the water jacket 40 approximately ½ inch away from water jacket 40 to provide a cooling effect on three sides or the air inducing air inducing donut 88. This configuration eliminates warping of the steel. The air duct 86 is provided with a split union 90 before the air inducing donut 88, such that air is supplied through a secondary air duct 86 to the ash tray 92 below the burn pot 6.

The air which is supplied to the ash tray 92 below the burn pot 6 is induced to the burn pot 6 in two manners. First, a central air inducer pipe 94 extends through the ignition plate 96 into the base of the burn pot 6. This air inducer pipe 94 is preferably 1½ inches in diameter and has a pattern of small air holes thereon. The air holes are preferably ¼ inch holes which introduces air to the center of the burn pot 6. Second, the ignition plate 96 is formed with a plurality of slots 98. The air can travel up from the ash tray 92 through the slots 98 to enter the burn pot 6. The ignition plate 96 stands off ⅛ inch from the water jacket 40. This gap also allows air to enter the burn pot 6. By this configuration, air is introduced from the sides, bottom, and center of the burn pot 6. This configuration provides air nearest to the combustion, which increases efficiency. The speed of the blower 84 rotation is determined by desired heat output set forth by smart thermostat or by the manual setting.

A safety door 100 stops air flow in event of system malfunction. The safety door 100 is controlled by a normally closed solenoid 102 which opens the safety door 100 for operation. An electromagnet 104 holds the safety door 100 open during operation. By utilizing an electromagnet, rather than the solenoid to hold the safety door 100 open for extended periods of time, the amount of noise created by the unit is reduced. If power is cut, the electromagnet 104 will release the safety door 100 and the safety door 100 is returned to its normally closed position which will prevent air infeed.

Figure 2:
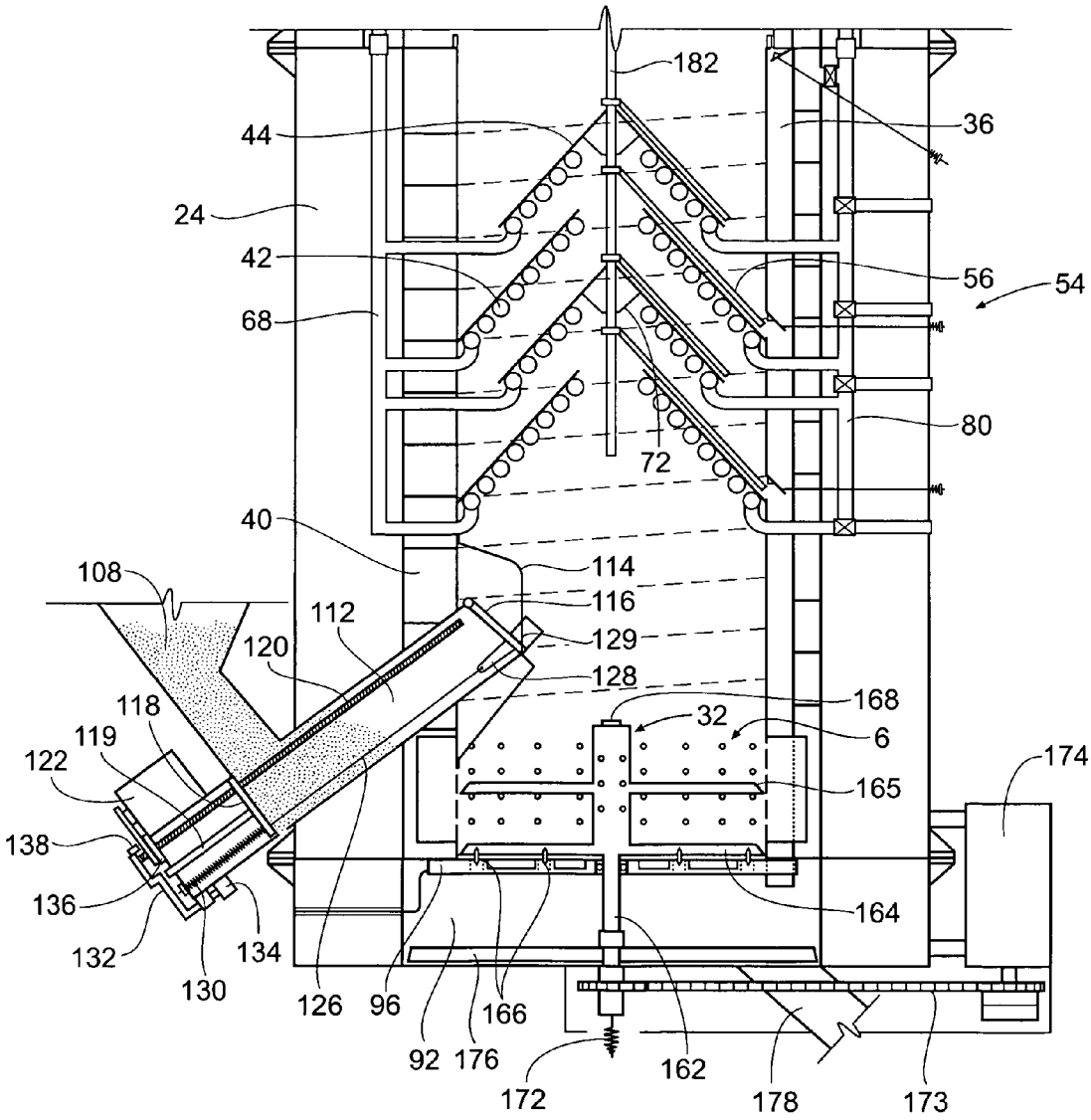
FIG. 2 is an interior view of lower portion of the furnace of the present invention, including the fuel infeed system.

The preferred embodiment of the fuel inlet system is shown in detail in FIG. 2. The fuel inlet system has a linear actuator dosing mechanism. A furnace hopper 108 feeds fuel into a fuel channel 112. The fuel channel 112 extends from the furnace hopper 108 into the burn pot 6. A deflecting shroud 114 is formed inside the burn pot 6 and is connected to the inner wall of the burn pot 6 near the outside of the fuel channel 112. The deflecting shroud 114 extends from the sidewall of the burn pot 6 and is angled up towards the center of the furnace 2. The shroud 114 extends past the door 116 to the fuel channel 112, and then has a slight cutback before extending vertically upward past the fuel channel door 116. After the fuel channel door 116, the shroud 114 extends back towards the inner wall of the furnace 2. This configuration deflects the air from the door 116 of the fuel channel 112, and increases the airspeed until the air is past the door 116 of the fuel channel 112. A plunger 118 is disposed within the channel 112 to advance the fuel into the burn pot 6. The plunger 118 is attached to a lead screw 120 which is in turn connected to a motor 122. The motor's 122 function is to rotate the lead screw 120 in a first direction to advance the plunger 118 and to rotate in a second direction to retract the plunger 118. The fuel channel 112 includes a pair of plunger stop sensors 124,125. The fuel inlet further includes a fuel channel door 116 hingedly attached to the end of the fuel channel 112 disposed within the furnace 2. The fuel channel door 116 is attached to a closure rod 126 by means of a pivotal linkage 128. The closure rod 126 is attached to a compression spring 130.

In use, a dose of fuel is delivered to the fuel channel 112 from the furnace hopper 108. The fuel channel 112 is pitched upward toward the burn pot 6 to prevent fire from entering the fuel channel 112. In the preferred embodiment, the angle of the fuel channel 112 is 22 degrees. The motor 122 rotates the lead screw 120 to advance the plunger 118. As the plunger 118 advances the fuel dose is advanced within the fuel channel 112. The fuel channel door 116 is pushed open by the force from the advancing dose and plunger 118. The dose of fuel is pushed into the furnace 2 and lands on the ignition plate 96 at the bottom of the burn pot 6. When the plunger 118 reaches the plunger advancement stop sensor 124, the motor 122 reverses its direction and rotates the lead screw 120 in the opposite direction to retract the plunger 118. As the plunger 118 retracts the fuel channel door 116 returns to its sealed closed position by the force of the compression spring 130 pulling on the door closure rod 126. As a measure of safety the door 116 has a weight 129 attached thereon, such that if the closure rod linkage 128 were to break, the weight of the door 116 will force it to close. The plunger 118 continues to retract into the until the plunger 118 reaches the plunger retraction stop sensor 125 at which point the plunger 118 is at its original position and the fuel channel 112 is ready to again receive a dose of fuel.

Safety sensors on the lead screw 120 and dose motor 122 provide elements of safety and will shut down the motor 122 if the unit is malfunctioning. Specifically, a strike 132 is associated with the motor end of the dosing channel 112. The strike 132 engages a normally closed limit switch 134. A mechanical malfunction will move the strike 132 and open the limit switch 134 will causes the motor 122 to stop. There are three mechanical failures which will cause the limit switch 134 to be opened. First, if the door closure rod linkage 128 breaks, the compression spring 130 will force the door closure rod 126 into the strike 132 to open the limit switch 134. Second, if the dose plunger 118 retracts too far a tab 119 on the plunger 118 will push against the strike 132 and open the limit switch 34. Third, a holddown bearing 136 is located on the lead screw 120 of the dose plunger 118. If the dose plunger 118 exceeds the shearing force for the holddown bearing bolts and the lead screw 120 will move towards the strike 132, and the limit switch 134 will be opened. As an additional measure of safety, the lead screw 120 includes a lobe 121 near the end of the screw 120 which is associated with a rotation limit switch counter 138. This rotation limit switch counter 138 will measure the number of times the lead screw 120 has been rotated anticipate the number of rotations in a cycle so that if there is a mechanical problem and the lead screw 120 is rotating too many times, the motor 122 will be shut down.

The hinged self closing fuel channel door 116 minimizes back burning in the fuel channel 112. The deflecting shroud 114 also aids in minimizing back burning in the fuel channel 112 by causing a vacuum effect which prevents air from the furnace 2 from being pushed into the fuel channel 112. The channel 112 is pitched up towards the burn pot 6, further preventing fire from entering the fuel channel 112. It should be noted that although the preferred fuel for this unit is grain, it is also contemplated that this invention could utilized with any biomass fuel.

Additionally, the furnace hopper 108 attached to the furnace 2 could also be automatically filled by a larger maxi-bin 140. The furnace hopper 108 includes a sensors which would actuate an auger 144 affixed to the furnace hopper 108. The furnace hopper 108 includes a funnel 146 which is attached to a pivoting arm 148 and a limit switch 150 located above the pivoting arm 148. That pivoting arm 148 is attached to a pull spring 152. When the furnace hopper 108 is full of fuel, the funnel 146 is depressed and which pushes the end of the pivoting arm 148 up against the limit switch 150. When the fuel in the furnace hopper 108 reaches a low level, the funnel 146 is lifted up and the end of the pivoting arm 148 is pulled down by the spring 152, removing the pivoting arm 148 from contact with the limit switch 150 which activates an auger 144 in an associated maxi-bin (not shown) to provide fuel to the furnace hopper 108. The top of the furnace hopper 108 has a plastic covering 154 and a limit switch 156 held above the furnace 108 hopper by an arm 155. As the furnace hopper 108 is filled with fuel, the plastic cover 154 rises. When the plastic cover 154 engages the limit switch 156, the auger 144 supplying fuel from the maxi-bin is turned off. The furnace hopper 108 may also include a sliding door 157 near the fuel channel 112, in order to easily remove the fuel from the furnace hopper 108 if maintenance to the furnace 2 is required.

Figure 11:
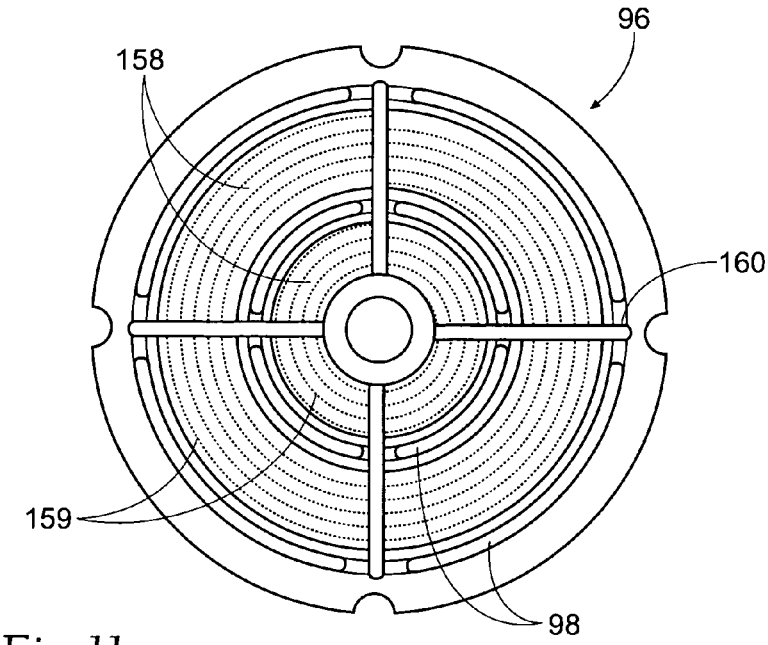
FIG. 11 is a top view of the ignition plate.

As described above, the ignition plate 96 is located at the bottom of the burn pot 6. The ignition plate 96 is shown in FIG. 11. The ignition plate 96 includes two annular recesses 158 which house an electrical ignition mechanism 159. Four tabs 160 are located on the surface of the ignition plate 96 to loosely hold the ignition elements 159 in place. These tabs 160 are installed in recesses in the plate 96, such that the tabs 160 are flush with the surface of the ignition plate 96. The ignition plate 96 also includes a plurality of slots 98. In the preferred embodiment, these slots 98 are beveled such that the slot is wider on the lower side of the ignition plate 96. In the preferred embodiment, the slots 98 are approximately 9/64 of an inch. The bevels improve the ash drop out which will be described below. The ignition plate 96 must be of a material that is tolerant to reach combustion temperatures of 1600 degrees F. The material must also be tolerant to abrasion and the impact of the biomass fuel. In the preferred embodiment, the ignition plate 96 is made of a metal material, however any other suitable material could also be used, as would be obvious to one of skill in the art.

The ash removal system can be best seen in FIG. 2. An ash tray 92 is located beneath the ignition plate 96. As the fuel is burned, ashes fall through the slots 98 in the ignition plate 96 into the ash tray 92. A shaft 162 extends through the bottom of the furnace 2, the ash tray 92, and the ignition plate 96 and extends into the burn pot 6. A fuel stirrer 32 is located just above the ignition plate 96 and is attached to the shaft 162. The fuel stirrer 32 has two sets of arms 164,165. The first set of arms 164 is located just above the surface of the ignition plate 96. The second set of arms 165 is located approximately halfway up the shaft 162. The blades on the arms 164,165 are beveled and sharp and extend close to, but not touching the water jacket 40 to avoid damaging the water jacket 40. The fuel stirrer 32 includes rotatable cutting wheels or projections 166 which engage the slots 98 of the ignition plate 96 to clean the slots 98 during rotation of the fuel stirrer 32. The fuel stirrer 32 is attached to the shaft 162 at the T-head 168 at the top of the shaft 162. There is an air gap between the top of the shaft 162 and the T-head 168 to give a margin of flexibility to the shaft 162 in a vertical direction. The shaft 162 is attached to a small spring in the bottom of the ash tray 92. This allows the shaft 162 to move slightly up and down and allows the cutter wheels or projections 166 to engage and disengage the slots 98. The shaft 162 is connected by a drive mechanism 173 to a rotator motor 174. When the motor 174 drives the shaft 162 to rotate, the fuel stirrer 32 is rotated which causes additional ashes to fall through slots 98 in the ignition plate 96. Removal of debris from the ignition plate 96 ensures proper air flow for combustion. The fuel stirrer 32 also serves to agitate the fuel to increase complete combustion of the fuel and further increase efficiency of the furnace 2 and break up any clinkers which may form. A clinker is a fragment of incombustible matter left after a wood, coal or charcoal fire.

Inside the ash tray 92, an ash arm 176 is attached to the shaft 162 just above the bottom surface of the ash tray 92. When the shaft 162 is rotated the ash arm 176 rotates and pushes any ashes which have accumulated into the removable ash slide 178. The removable ash slide 178 may include a mechanism such as an auger 180 to remove the ashes from the furnace 2. In the preferred embodiment, the ash auger 180 would run for approximately 30 seconds after 60 minutes of cumulative furnace 2 operation. The auger is located near the baffled sediment tank 38 and the base of the auger 180 is constantly immersed in water. This water acts as a dam to prevent unwanted air to flow to or from the furnace 2. The auger 180 runs relatively slowly, so that the debris is dried by the time it reached the end of the auger 180. However, it is also contemplated that the ash slide 178 may simply deposit ashes into an appropriate disposal container.

The furnace 2 includes a wash down system which can best be seen in FIG. 4. The wash down system functions to clean ash and other debris from the furnace 2. The wash down system includes a pipeshaft 182 which is attached to a pipeshaft motor 34. The pipeshaft motor 34 is provided outside of the furnace 2 to rotate the pipeshaft 182. The pipeshaft 182 is attached to a water supply 184; the water supply pipe 184 includes electric solenoid valves (not shown). The pipeshaft 182 has numerous washdown holes provided thereon. The holes can be of any size which provides adequate volume and pressure of fluid to achieve sufficient washdown of the furnace 2; however the preferred embodiment provides holes which are approximately 1/16" in diameter. The water supplied to the washdown cycle can optionally include an additive, such as a cleaning agent, to aid in cleaning the unit. The water solution is pumped, filtered, and reused in subsequent cycles.

Figure 7:
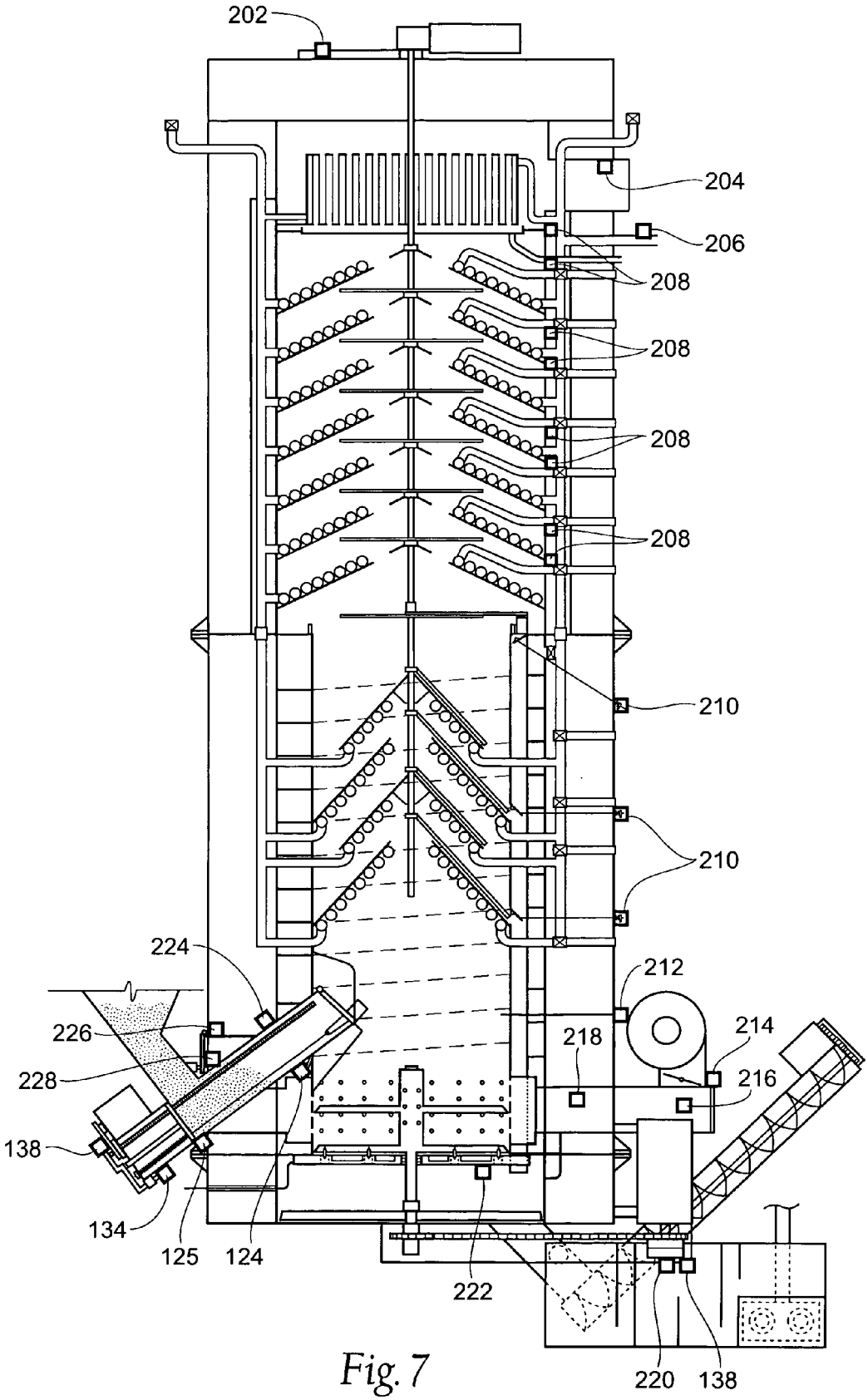
FIG. 7 is a simplified interior view of the furnace of the present invention which shows the locations of the system sensors.
Figure 8:
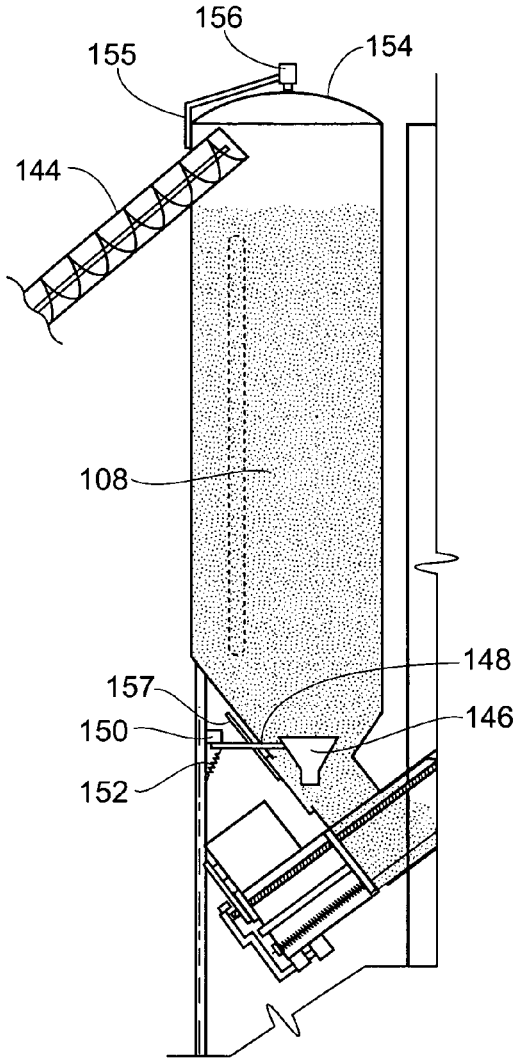
FIG. 8 is an interior view of the fuel hopper attached to the fuel infeed system.
Figure 9:
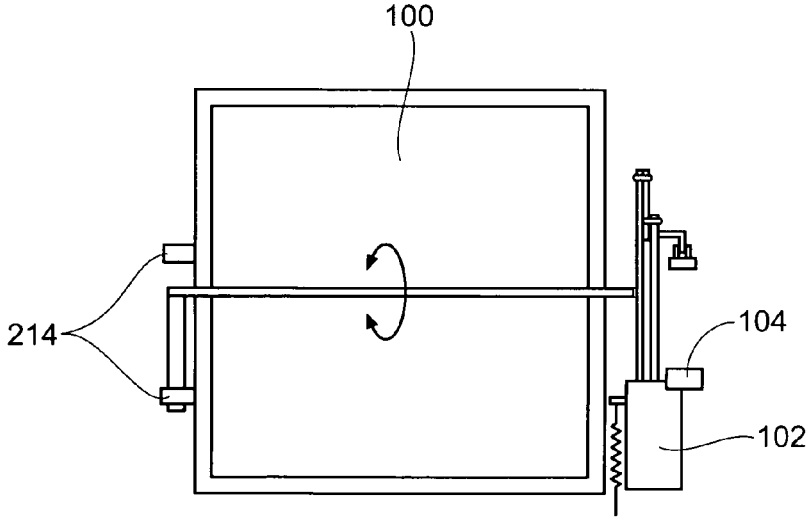
FIG. 9 is a top view of a portion of the air intake system.
Figure 10:
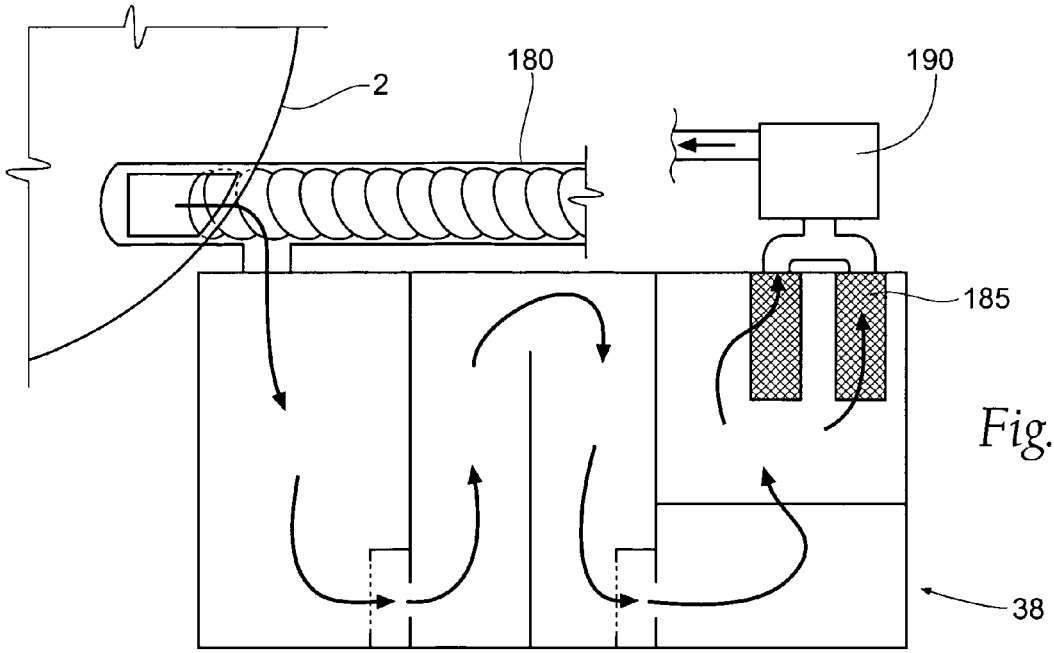
FIG. 10 is an interior view from the top of the baffled sediment tank and the ash auger.

In the preferred embodiment, the water solution is stored in a baffled sediment tank 38 of approximately 18 gallons, shown in FIGS. 6, 7 and 10. It is important to use enough water for adequate cleaning of the system without using too much water, which can flood out key components of the system. The baffled sediment tank 38 allows the ash to sink in the tank. In this manner, most of the solids are removed from the water solution before reaching the filters and pump 190. The baffled sediment tank 38 includes a removable cover for access to clean the tank 38. The washdown cycle can be initiated either manually or automatically.

As described above, the furnace 2 is formed with a number of ash funnels 44 and tripod legs 46 to which the heat exchanger heli-coils 42 are attached. In the preferred embodiment four sets of ash funnels 44 are provided in the lower portion 54 of the furnace 2 and seven sets of tripod legs 46 are provided in the upper portion 52 of the furnace 2. The ash funnels 44 and tripod legs 46 are attached to the inner wall of the furnace 2.

Each set of ash funnels 44 in the lower portion 54 of the furnace 2 has an ash wiper 56 located in close proximity thereto. In the preferred embodiment the ash wipers 56 are magnetic; however it is also contemplated that the ash wipers 56 could have a different configuration, such as having metal bristles attached to the wiping surface. The ash wipers 56 are attached to the pipeshaft 182, such that when the pipeshaft 182 rotates, the ash wiper 56 rotates. The ash caseway 36 is a tube positioned just inside the water jacket 40 surrounding the furnace 2. The caseway 36 includes magnetic doors 196 located just above the point where the first and third ash funnels 44 are attached to the caseway 36. An additional magnetic door 196 is provided at the top of the caseway 36 in the area where the lower portion 54 and the upper portion 52 of the furnace 2 are mated. This door 196 is an exit point for condensate during operation of the furnace 2. Additionally, the debris and fluid from the washdown cycle are discharged through this door 196.

In use, the pipeshaft motor 34 is operated to rotate the pipeshaft 182. Water is supplied to the pipeshaft 182 through the water supply pipe 184. When water is supplied to the pipeshaft 182 and the pipeshaft 182 is rotated water is flung from the pipeshaft holes to clean the furnace 2. As the pipeshaft 182 is rotated, the ash wipers 56 which are hingedly attached to the pipeshaft 182 also rotate. The rotation of the ash wipers 56 causes any debris on the ash funnel 44 to be pushed away. The second and fourth lower funnels 44 are attached to tripod legs 46 which protrude from the funnel 44 to mate with notches formed in the inner wall of the furnace 2. The configuration of the ash funnels 44 is such that as the water and debris from the second and fourth set of ash funnels 44 will fall onto the first and third set of ash funnels 44. The debris and water on the first and third ash funnels 44 are pushed towards the ash caseway 36. The trough 50 at the connection area of the lower portion 54 and upper portion 52 of the furnace 2 also collects water and debris and, as described above, contains a additional magnetic door 196. The magnetic doors 196 of the ash caseway 36 are pushed open as the wipers 56 from the rotating shaft come in close proximity with the door. Each door 196 includes a protrusion. As the wiper 56 rotates, the wiper 56 engages the protrusion and opens the door 196 and allows the water and debris to fall down the ash caseway 36 and into the ash tray 92. The magnetic door 196 is biased such that when the force of the water and debris recedes, the door 196 returns to its closed position. Sensors show door 196 position. An open door during burn status can be closed manually or by automatic means. A small electric solenoid is connected to each magnetic door 196 to push the door 196 shut if necessary. The steps of operation of the wash down system will be described in more detail below.

As is seen in FIG. 1 the furnace 2 includes a computer 16 which controls the system. A number of sensors throughout the system provide data to the computer 16. The locations of the primary sensors are shown in FIG. 7; however additional sensors may be utilized. The sensors includes a limit switch on a normally closed electric solenoid 202, an exhaust temperature sensor 204, an outlet temperature sensor 206, a plurality of monitoring temperature sensors 208, a plurality of door position limit switches 210, a removable burn pot temperature probe 212, an air door position sensor 214, an air inlet temperature sensor 216, a water column sensor 218, a torque clutch with reversing sensor 220, an ignition plate current sensor 222, a fuel channel temperature sensor 224, a water inlet temperature sensor 226, a door closure sensor 228, a plunger advancement stop sensor 124, a plunger retraction stop sensor 125, a normally closed limit switch 134, a rotation limit switch counter 138.

There are six main sequences: a start up sequence, an ignition sequence, a high burn sequence, a selection sequence which selects between low burn, intermediate burn, burnout, and washdown, a low burn sequence, and an intermediate burn sequence. Each of the sequences combines activities including, but not limited to rotating the fuel stirrer, activating the air blower 84, activating the igniter 159, administering doses of fuel, ash dispensing, washdown, and selection of burn status. The computer 16 and program utilize the sensor data to determine which step of the program is to be completed. The unit also includes a smart logic thermal controller.

Figure 12:
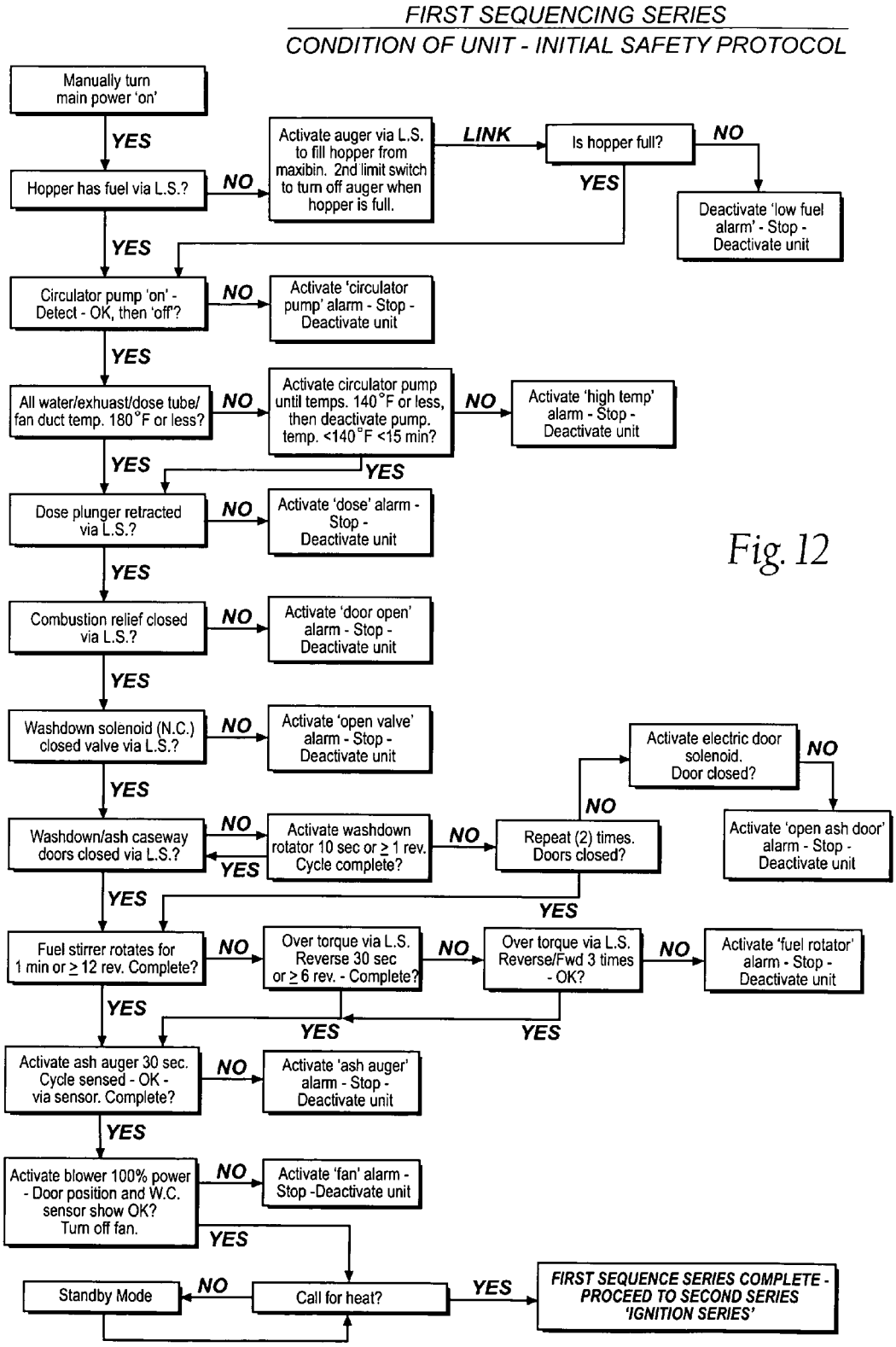
FIG. 12 is a flow chart depicting the initial safety protocol.
Figure 13:
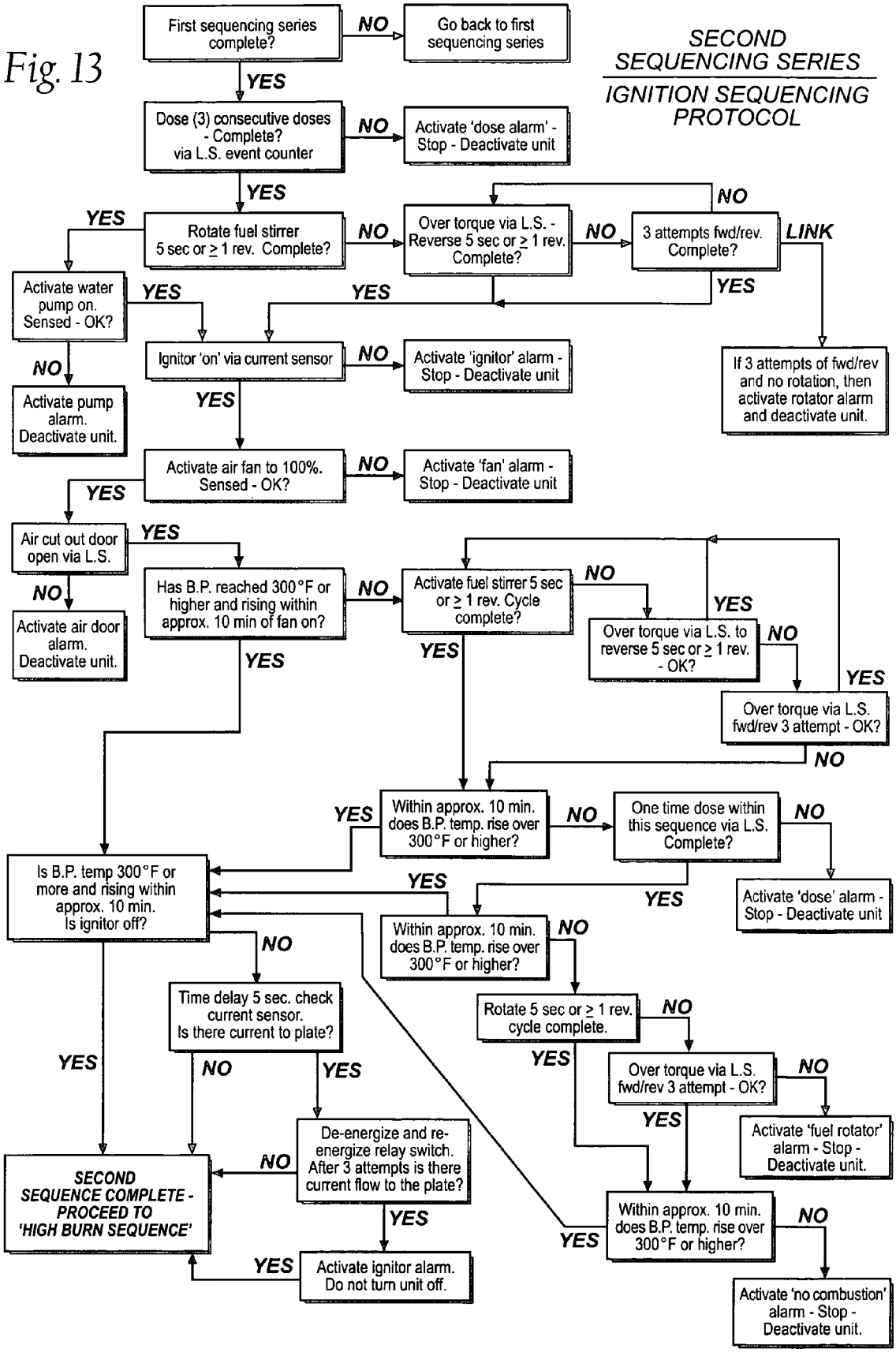
FIG. 13 is a flow chart depicting the ignition sequencing protocol.
Figure 14:
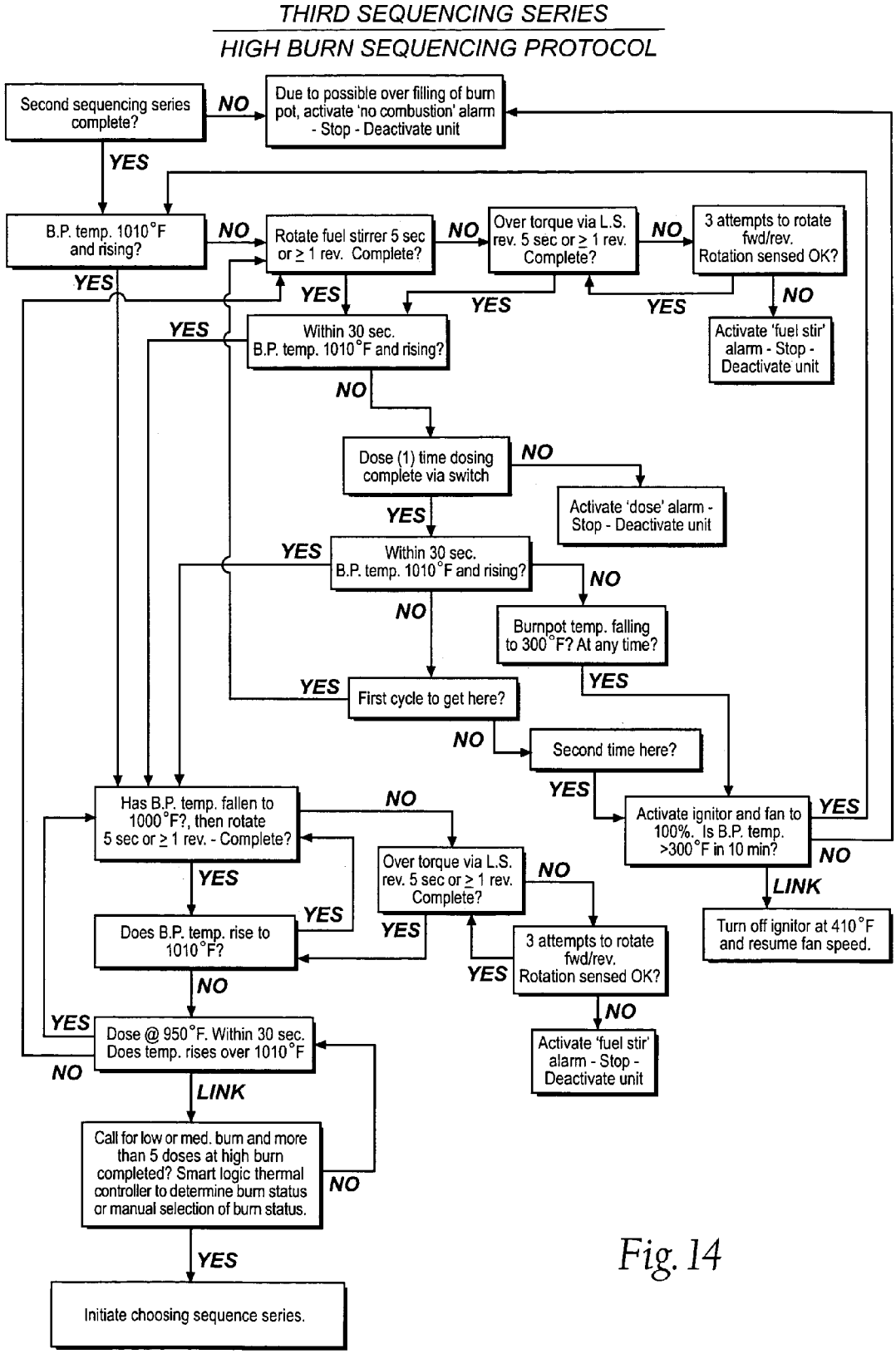
FIG. 14 is a flow chart depicting the high burn sequencing protocol.
Figure 15:
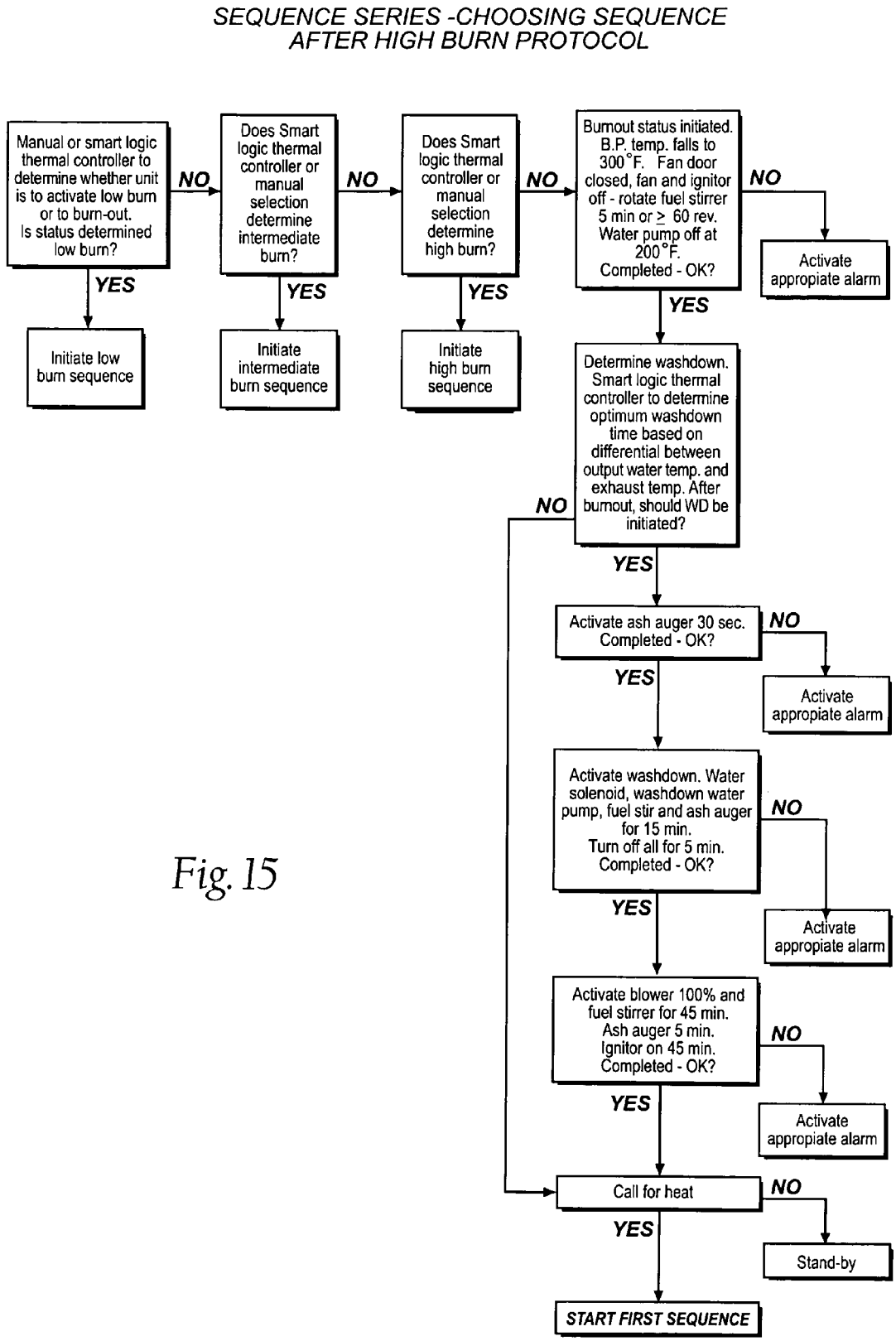
FIG. 15 is a flow chart depicting the choosing sequence.
Figure 16:
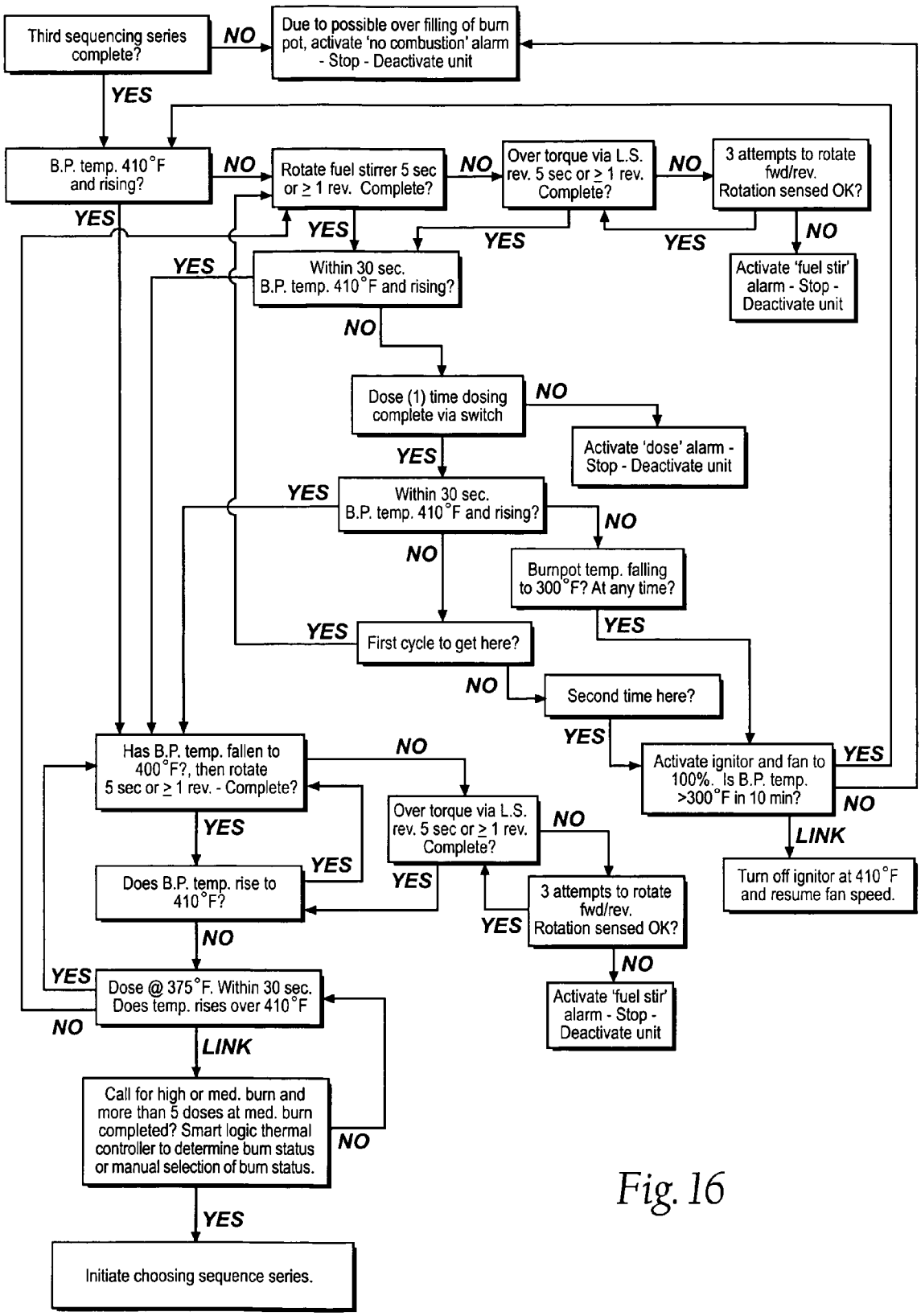
FIG. 16 is a flow chart depicting the low burn sequencing protocol.
Figure 17:
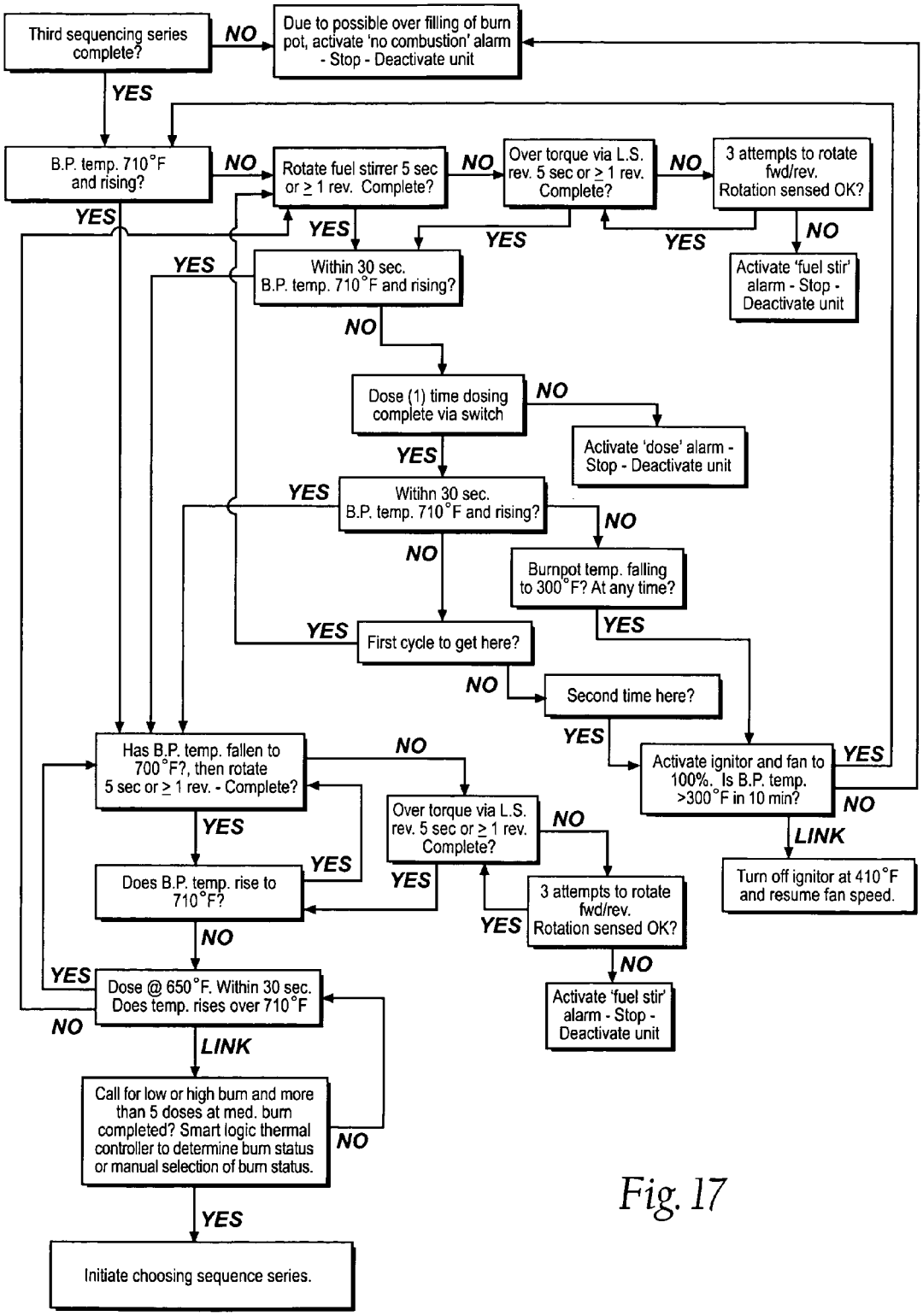
FIG. 17 is a flow chart depicting the intermediate burn sequencing protocol.

FIGS. 12-17 are flowcharts which show the various sequencing series by which the furnace 2 operates. FIG. 12 is the First Sequencing Series, which is the initial start up and safety check protocol. FIG. 13 is the Second Sequencing Series, which is the ignition sequencing protocol. FIG. 14 is the Third Sequencing Series, which is the high burn sequencing protocol. FIG. 15 is the Sequence Series, which is the low burn, intermediate burn, burnout, and/or wash down selection sequence. FIG. 16 is the low burn sequencing protocol. FIG. 17 is the intermediate burn sequencing protocol. FIGS. 12-17 use a number of abbreviations of parts of the system. For example, B.P. stands for burn pot, L.S. stands for limit switch, W.D. stands for wash down, W.C. stands for water column, and SLTC stands for smart logic thermal controller.

As illustrated in FIG. 12, the computer 16 tests various elements of the unit as an initial safety protocol. Specifically, when the main power is manually on, the computer 16 tests whether the furnace hopper 108 has fuel. Whether the furnace hopper 108 has fuel is tested by the limit switch associated with the furnace hopper 108. If the furnace hopper 108 does not have fuel, a limit switch activates the auger 144 to rotate. When the furnace hopper 108 is full an additional limit switch turns off the auger 144 to the furnace hopper 108. The computer 16 also turns the circulator pump 30 on, tests whether it is functioning, and then turns it off. The computer 16 tests whether all water, exhaust, dose tube, and fan duct temperatures are 180 degrees F. or less. The computer 16 tests, by means of separate limit switches, whether the fuel plunger 118 is retracted, the combustion release door 201 is closed, the wash down solenoid valves are closed, and whether the wash down ash caseway doors 196 are closed. The computer 16 also rotates the fuel stirrer 32 for one minute and or greater than or equal to 12 revolutions and tests to see if it is complete. The computer 16 activates the ash auger 180 for 30 seconds, and then tests whether the cycle is complete. The computer 16 also activates the blower 84 to 100 percent power then turns off the fan and tests whether the wash down caseway sensors are ok. The computer 16 then tests whether there is a call for heat. If there is a call for heat the computer 16 proceeds to the second sequence. If there is no call for heat, the unit is put in stand by mode. If the unit fails any of the tests above, the computer 16 either attempts to solve the failure, or deactivates the unit and activates an associated alarm. If the computer 16 attempts to solve the failure and still fails, the unit is deactivated and the associated alarm is activated.

As illustrated in FIG. 13, the second sequence is the ignition sequence. The computer 16 provides three consecutive doses of fuel to the furnace 2, and tests whether this has been completed using a limit switch with an event counter. Motor rotation is verified at each does. If the three doses are complete, the fuel stirrer 32 is then rotated for 5 seconds or greater than or equal to one revolution. Motor rotation is verified at each operation. If the fuel stirring step is complete, the computer 16 turns on the water pump 30. If the water pump 30 has properly tuned on, the computer 16 turns the igniter 159 on. The computer 16 tests whether there is current to the igniter plate 96. If the current sensor shows there is current to the plate 96, the computer 16 activates the air fan 84 to 100% and tests whether the fan 84 is at 100%. If the air fan 84 is at 100% the computer 16 then tests whether the air cut out door 100 is open. This is tested via a limit switch. If the air cut out door 100 is open, the computer 16 tests whether the burn pot 6 temperature of 300 degrees F. or higher and rising within approximately 10 minutes of turning the fan 84 on. If this condition is satisfied the computer 16 turns the igniter 159 off at a burn pot 6 temperature of 300 degrees F. or more. While the burn pot 6 temperature is rising, the computer 16 proceeds to the third sequence. If the unit fails any of the tests described above, the computer 16 either deactivates the unit and activated an appropriate alarm, or attempts to fix the problem through the steps shown in FIG. 13. If the problem cannot be fixed by the steps shown in FIG. 13, the computer 16 deactivates the unit and activates an appropriate alarm. As illustrated in FIG. 14, the third sequence is a high burn protocol. In the high burn protocol the computer 16 tests whether the burn pot 6 temperature is 1010 degrees F. and rising. If the burn pot 6 temperature is 1010 degrees F. and rising, the computer 16 waits until the burn pot 6 temperature has fallen to 1000 degrees F. then rotates the fuel stirrer 32 for 5 seconds or greater than or equal one rotation. If the fuel stirrer 32 has successfully been rotated for 5 seconds, or greater than or equal one rotation, the computer 16 tests whether the burn pot 6 temperature has risen above 1010 degrees F. If the burn pot 6 temperature has risen above 1010 degrees F., the computer 16 repeats the previous step of rotating the fuel stirrer 32 when the burn pot 6 temperature falls to 1000 degrees F. If the burn pot 6 temperature has not risen to 1010 degrees F., the computer 16 has a dose of fuel delivered to the burn pot 6 when the burn pot 6 temperature falls to 950 degrees F. Within 30 seconds, the computer 16 tests whether the temperature has risen to over 1010 degrees F. If the temperature has reached more than 1010 degrees F., the computer 16 returns to the step of waiting for the burn pot 6 temperature to falls to 1000 degrees F. and rotating the fuel stirrer 32 for five seconds or at least one revolution and repeats above described procedure. At that point, if there is a call for low or medium burn and more than five doses have been administered in the high burn sequence, the computer 16 runs the low or medium burn sequence. The selection of burn status is determined by the smart logic thermal controller or by manual selection. As described with regard to the previous sequences, if the unit fails any of the tests described above, the computer 16 either deactivates the unit and activated an appropriate alarm, or attempts to fix the problem through the steps shown in FIG. 14. If the problem cannot be fixed by the steps shown in FIG. 14, the computer 16 deactivates the unit and activates an appropriate alarm.

As illustrated in FIG. 15, the fourth sequence is the choosing sequence after high burn protocol. In this sequence the computer 16, with input from either the smart logic thermal controller or manual input, determines whether to run the low burn, intermediate burn, burn out status or wash down sequence. The computer 16 uses either manual input or a smart logic thermal controller to determine whether the unit is to activate low burn status. If the unit is to activate low burn status, the unit runs the low burn sequence. If the unit is not to activate low burn status, the computer 16 tests whether the unit to activate intermediate burn status. If the unit is to activate intermediate burn, the intermediate burn sequence is run. In the unit is not told to activate intermediate burn, the computer 16 goes to the burnout sequence.

The burnout sequence can be initiated either manually or by the smart logic thermal controller. The burnout cycle is also shown in FIG. 15. In the burn out sequence when the burn pot 6 temperature falls to 300 degrees F., the fan 84 is turned off and the fuel stirrer 32 is rotated for 5 minutes or 60 revolutions. The water pump 30 is turned off at 200 degrees F. The optimum washdown time is determined based on the differential between the output water temperature and the exhaust air temperature. As the differential between the two temperatures increases, the inefficiency of the unit is also increasing. The controller makes a decision on the optimum time for washdown based on the temperature differential as well as other factors. For example, if the ambient air temperature is too low, the unit will not go through the washdown process. The burnout sequence is also described in FIG. 15.

If the smart logic controller determines that it is not an appropriate time to run the washdown cycle, the computer 16 tests whether there is a call for heat. If there is a call for heat the computer 16 runs the first sequence, the safety protocol. If there is no call for heat the unit is put to standby. The wash down cycle is also shown in FIG. 15. In the washdown sequence, the ash auger 180 is activated for 30 seconds. If this is completed successfully the water solenoid 186, washdown water pump 190, washdown pipeshaft motor 34, wash down pipeshaft 182, fuel stirrer 32, and ash auger 180 are activated for 15 minutes. Water pump 190 is deactivated for 5 minutes before the next step. This allows water within the furnace 2 to drain out. This allows the unit to dry out. The fan 84 is activated and the igniter plate 96 is activated to prevent corn from entering wet furnace 2. If this is completed successfully, the air blower 84 is activated at 100 percent for 45 minutes, the fuel stirrer 32 for 45 minutes and ash auger 180 are activated for 5 minutes and the igniter 159 is activated for 45 minutes. If this is completed successfully, the computer 16 tests whether there is a call for heat. If there is a call for heat the first sequence is run. If there is no call for heat the unit is put to standby. As described with regard to the previous sequences, if the unit fails any of the tests described above, the computer 16 either deactivates the unit and activated an appropriate alarm, or attempts to fix the problem through the steps shown in FIG. 15. If the problem cannot be fixed by the steps shown in FIG. 15, the computer 16 deactivates the unit and activates an appropriate alarm.

The low burn protocol is shown in FIG. 16. In the low burn protocol the computer 16 tests whether the burn pot 6 temperature is 410 degrees F. and rising. If the burn pot 6 temperature is 410 degrees F. and rising, the computer 16 waits until the burn pot 6 temperature has fallen to 400 degrees F. then rotates the fuel stirrer 32 for five seconds or greater than or equal one rotation. If the fuel stirrer 32 has successfully been rotated for 5 seconds, or greater than or equal one rotation, the computer 16 tests whether the burn pot 6 temperature has risen above 410 degrees F. If the burn pot 6 temperature has risen above 410 degrees F., the computer 16 repeats the previous step of rotating the fuel stirrer 32 when the burn pot 6 temperature falls to 400 degrees F. If the burn pot 6 temperature has not risen to 410 degrees F., the computer 16 has a dose of fuel delivered to the burn pot 6 when the burn pot 6 temperature falls to 375 degrees F. Within 30 seconds, the computer 16 tests whether the temperature has risen to over 410 degrees F. If the temperature has reached more than 410 degrees F., the computer 16 returns to the step of waiting for the burn pot 6 temperature to fall to 400 degrees F. and rotating the fuel stirrer 32 for five seconds or at least one revolution and repeats above described procedure. At that point, if there is a call for high or medium burn and more than five doses have been administered in the low burn sequence, the computer 16 runs the high or medium burn sequence. The selection of burn status is determined by the smart logic thermal controller or by manual selection. As described with regard to the previous sequences, if the unit fails any of the tests described above, the computer 16 either deactivates the unit and activated an appropriate alarm, or attempts to fix the problem through the steps shown in FIG. 16. If the problem cannot be fixed by the steps shown in FIG. 16, the computer 16 deactivates the unit and activates an appropriate alarm.

FIG. 17 shows the intermediate burn sequence. In the intermediate burn protocol the computer 16 tests whether the burn pot 6 temperature is 710 degrees F. and rising. If the burn pot 6 temperature is 710 degrees F. and rising, the computer 16 waits until the burn pot 6 temperature has fallen to 700 degrees F. then rotates the fuel stirrer 32 for five seconds or greater than or equal one rotation. If the fuel stirrer 32 has successfully been rotated for five seconds, or greater than or equal one rotation, the computer 16 tests whether the burn pot 6 temperature has risen above 710 degrees F. If the burn pot 6 temperature has risen above 710 degrees F., the computer 16 repeats the previous step of rotating the fuel stirrer 32 when the burn pot 6 temperature falls to 700 degrees F. If the burn pot 6 temperature has not risen to 710 degrees F., the computer 16 has a dose of fuel delivered to the burn pot 6 when the burn pot 6 temperature falls to 650 degrees F. Within 30 seconds, the computer 16 tests whether the temperature has risen to over 710 degrees F. If the temperature has reached more than 710 degrees F., the computer 16 returns to the step of waiting for the burn pot 6 temperature to fall to 700 degrees F. and rotating the fuel stirrer 32 for 5 seconds or at least one revolution and repeats above described procedure. At that point, if there is a call for low or high burn and more than five doses have been administered in the intermediate burn sequence, the computer 16 runs the low or high burn sequence. The selection of burn status is determined by the smart logic thermal controller or by manual selection. As described with regard to the previous sequences, if the unit fails any of the tests described above, the computer 16 either deactivates the unit and activated an appropriate alarm, or attempts to fix the problem through the steps shown in FIG. 17. If the problem cannot be fixed by the steps shown in FIG. 17, the computer 16 deactivates the unit and activates an appropriate alarm.

If at any time during a call for heat, whether high, intermediate, or low burn sequence, if the burn pot 6 tem falls to 300 degrees F. or less, the igniter 159 will activate and the fan speed 84 will increase to 100 percent. Both will activate for approximately 10 minutes. At this point one dose of fuel will also be administered. If the burn pot 6 temp rises to 410 degrees F. and rising within the 10 minutes the igniter 159 will be deenergized and the fan 84 speed will resume its speed based on the burn status which was its related burn status. The burn status will then continue as previously described. If combustion does not occur, an appropriate alarm will be indicated.

It should be noted that the entire furnace 2 can be taken apart for maintenance purposes. The top of the furnace 2 has a removable cover 200. All of the heat exchangers can be disconnected and removed from the system. The heli-coil tripod legs 46 are hinged to allow the legs 46 to be pulled out of the furnace 2.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A biomass burning furnace system comprising: furnace body including a lower portion and an upper portion, said furnace body further including an inner surface and an outer surface; a burn pot located in the lower portion of the furnace; an ash tray located beneath the burn pot; a three stage heat exchanger system; said three stage heat exchanger further including a first stage heat exchanger comprising a spiral water jacket surrounding the burn pot; a second stage heat exchanger comprising a plurality of heli-coils; and a third stage heat exchanger comprising a finned heat exchanger in the upper portion of the furnace, above said plurality of heli-coils; a fuel infeed system to provide fuel to the burn pot, said fuel infeed system including a fuel channel and a linear actuator mechanism to advance fuel through the fuel channel; a washdown system to remove debris from the inner surfaces of the furnace; an air inducing system to provide air to the burn pot; and a control system to control components of the furnace.

2. A furnace as in claim 1 wherein said plurality of heli-coils further comprises: a plurality of heli-coils strapped to ash funnels, said ash funnels being attached to the furnace body in the lower portion of the furnace; and a plurality of heli-coils strapped to tripod legs, said tripod legs being attached to the furnace body in the upper portion of the furnace.

3. A furnace as in claim 2 further comprising: a rotatable washdown pipeshaft extending from the top of the furnace, generally through the center of the furnace, said washdown pipeshaft further including a plurality of rotator shaft sleeves; said tripod legs being attached at one end to the inner surface of the furnace body and at the other end to a rotator shaft sleeve; said ash funnels having a top surface and a lower surface, and at least one of said ash funnels having a funnel shaped heat deflector attached to the lower surface thereof; and a plurality of heat baffles are located in the upper portion of the furnace, each heat baffle being located directly below a heli-coil, each of said heat baffles being connected to a rotator shaft sleeve.

4. A furnace as in claim 1 wherein said first stage heat exchanger, said second stage heat exchanger, and third stage heat exchanger are in parallel arrangement.

5. A furnace as in claim 1 further comprising: a water infeed to supply water to the heat exchangers; said water infeed splitting to form a first inlet pipe and an inlet manifold; said first inlet pipe supplying water to said spiral water jacket; said inlet manifold extending vertically up the outside surface of the furnace body to supply water to each successive helicoil and the fine finned heat exchanger; an outlet manifold extending vertically along the outside surface of the furnace body, said outlet manifold collecting the water which has flowed through the spiral water jacket, each successive helicoil, and the fine finned heat exchanger, said outlet manifold supplying water to the water outlet.

6. A furnace as in claim 3 wherein said washdown system further comprises: a washdown fluid supply; a pipeshaft motor; said rotatable pipeshaft connected to said pipeshaft motor by a reversible clutch, said rotatable pipeshaft including a plurality of holes therein, such that when water is provided to the rotatable pipeshaft from the fluid supply, and the pipeshaft is rotated by the pipeshaft motor, water is flung from the plurality of holes to clean debris from the inside of the furnace; at least one wiper attached to said rotatable pipeshaft, said at least one wiper being located directly above an ash funnel, such that as the pipeshaft rotates, the wiper is rotated and debris is pushed from the ash funnel; an ash caseway, said ash caseway being formed as a tube extending vertically along the inner surface of the furnace, said caseway ending in the ash tray; at least one magnetic door being formed at the end of said ash funnel, said magnetic door leading to said ash caseway, said magnetic door further including a protrusion engagable with said wiper, such that as said wiper is rotated the wiper engages the protrusion, pushes the magnetic door open, and pushes the debris down the ash caseway, each of said magnetic doors may be attached to a solenoid in order to actuate said magnetic doors; an ash chute located in said ash tray, such that debris in the ash tray is removed from the ash tray through the ash chute, said ash chute including an inlet hole for a baffled water tank, said ash chute including a first end and a second end; said baffled water tank including several baffles and filter to clean debris from the washdown fluid, said baffled water tank further being connected to the washdown fluid supply; and an ash auger located at the second end of said ash chute, said ash auger being adapted to remove ash from the bottom of the ash chute.

7. A biomass burning furnace system comprising: furnace body including a lower portion and an upper portion, said furnace body further including an inner surface and an outer surface; a burn pot located in the lower portion of the furnace; an ignition plate located at the bottom of the burn pot, said ignition plate having a top surface, said ignition plate having at least one annular recess formed on the top surface thereof and a plurality of slots extending through the ignition plate; an ignition mechanism disposed in said at least one annular recess, said ignition mechanism being held in place by at least one tab; a rotatable shaft extending through about the center of the ignition plate, said rotatable shaft being connected through a reversible drive mechanism to a motor, wherein operation of said motor causes rotation of the rotatable shaft; and a fuel stirrer connected to said rotatable shaft extending through the center of the ignition plate, said fuel stirrer having at least one set of arms extending axially from said shaft, wherein one set of arms is located just above the top surface of the ignition plate, wherein rotation of said rotatable shaft causes rotation of the fuel stiffer; an ash tray located beneath the burn pot; a three stage heat exchanger system; a fuel infeed system to provide fuel to the burn pot, said fuel infeed system including a fuel channel and a linear actuator mechanism to advance fuel through the fuel channel; a washdown system to remove debris from the inner surfaces of the furnace; an air inducing system to provide air to the burn pot; and a control system to control components of the furnace.

8. A furnace as in claim 7 wherein the fuel stirrer further includes a plurality of rotatable wheels or projections attached to the bottom surface of the set of arms just above the top surface of the ignition plate, said plurality of rotatable wheels or projections being adapted to engage the plurality of slots formed on the surface of the ignition plate.

9. A furnace as in claim 7, wherein said air inducing system further comprises: a variable speed air blower; an air inducing donut surrounding said burn pot, said air inducing donut being formed with a plurality of air holes; a central air inducing pipe which extends from the ash tray below the burn pot, through the center of the ignition plate into the burn pot and surrounds the central shaft, said central air inducing pipe being formed with a plurality of air holes; and an air duct connected to said variable speed air blower, said air duct supplying air to the air inducing donut and to the ash tray, such that the air supplied to the ash tray enters the burn pot through the slots on the ignition plate and the air holes in the central air inducing pipe.

10. A biomass burning furnace system comprising: furnace body including a lower portion and an upper portion, said furnace body further including an inner surface and an outer surface; a burn pot located in the lower portion of the furnace; an ash tray located beneath the burn pot; a three stage heat exchanger system; a fuel infeed system to provide fuel to the burn pot, said fuel infeed system including a fuel channel and a linear actuator mechanism to advance fuel through the fuel channel; a furnace hopper to hold fuel; said fuel channel extending from said furnace hopper to the furnace, said fuel channel having a first end outside the furnace and a second end inside the furnace; a plunger linearly disposed within said fuel channel; a lead screw attached to said plunger, said lead screw being engaged to a reversible motor by a drive mechanism; operation of the said motor in a first direction causes rotation of the lead screw in a first direction, which causes advancement of the plunger; operation of said motor in a second direction causes rotation of the lead screw in a second direction, which causes retraction of the plunger; a hinged door located at the second end of the fuel channel inside the furnace, said hinged door including a weight to aid in closing the hinged door; a door closure rod being attached to said door by a pivotal linkage, said door closure rod further being attached to a compression spring which aids in pulling the hinged door to a closed position; said plunger being adapted to causes the hinges door to be pushed open and fuel to be deposited into the furnace when said plunger is in its fully advanced position; a washdown system to remove debris from the inner surfaces of the furnace; an air inducing system to provide air to the burn pot; and a control system to control components of the furnace.

11. A furnace as in claim 10 wherein said fuel channel is angled upward from said furnace hopper toward said furnace and said hinged door is cut back such that said hinged door is not perpendicular to the length of the fuel channel.

12. A furnace as in claim 10 wherein said furnace hopper further includes: a bulk fuel storage bin located next to said furnace hopper; a auger extending from said bulk storage bin to said furnace hopper, whereby operation of said auger causes fuel to be transferred from said bulk storage bin to said furnace hopper; low fuel sensor on the furnace to sense when the furnace hopper is almost empty and supply a signal to the auger; a high fuel sensor on the furnace to sense when the furnace hopper is full and supply a signal to the auger; wherein a signal from the low fuel sensor activates the auger to rotate and a signal from the high fuel sensor causes the auger to stop rotating.

13. A biomass burning furnace system comprising: furnace body including a lower portion and an upper portion, said furnace body further including an inner surface and an outer surface; a burn pot located in the lower portion of the furnace; an ash tray located beneath the burn pot; a three stage heat exchanger system; a fuel infeed system to provide fuel to the burn pot, said fuel infeed system including a fuel channel and a linear actuator mechanism to advance fuel through the fuel channel; a washdown system to remove debris from the inner surfaces of the furnace; an air inducing system to provide air to the burn pot; and a control system to control components of the furnace, said control system includes: a computer controller mounted to the furnace and adapted for controlling and sequencing operation of the elements of the furnace; a smart logic thermal controller to provide signals to the computer controller; a plurality of sensors located throughout the furnace, each of said plurality of sensors providing signal to the computer controller and the smart logic thermal controller; and said computer controller adapted to receive input from the sensors and run a predetermined program to control components of the furnace; an ignition plate located in the bottom of said burn pot, said ignition plate including an electric ignition mechanism, wherein said computer is electrically connected to said ignition plate for regulating ignition of fuel in the furnace; a rotatable shaft extending through about the center of the ignition plate, said rotatable shaft being connected through a reversible drive mechanism to a motor, wherein operation of said motor causes rotation of the rotatable shaft; a fuel stirrer connected to said rotatable shaft extending through the center of the ignition plate, said fuel stirrer having at least one set of arms extending axially from said shaft, wherein one set of arms is located just above the surface of the ignition plate, wherein rotation of said rotatable shaft causes rotation of the fuel stirrer; and said wherein said computer is electrically connected to said motor for regulating the rotation of the fuel stirrer to agitate the fuel.

14. The furnace as in claim 13 wherein said computer is electrically connected to said washdown system to regulate the cleaning of the furnace.

15. A method of operating a computer controller communicating with a furnace for effecting operation of the furnace, said furnace including a plurality of components and sensors associated with the components, the method comprising the steps of: (a) performing an initial safety protocol sequence; (b) performing an ignition sequence; (c) performing a high burn sequence; and (d) performing a choosing sequence wherein said choosing sequence includes the steps of (a) determining whether the burn status required is low burn, proceeding to (a) (1) if low burn status is required and proceeding to (b) if low burn is not required; (a) (1) initiating a low burn sequence; (b) determining whether the burn status required is intermediate burn, proceeding to (b) (1) if intermediate burn is required and proceeding to (c) if intermediate burn is not required; (b) (1) initiating intermediate burn sequence; (c) determining whether the burn status required is burn out, proceeding to (c) (1) if burn out is required and proceeding to (d) if intermediate burn is not required; (c) (1) initiating burn out sequence; and (d) determining whether to run the washdown cycle.

16. A method of operating a computer controller communicating with a furnace for effecting operation of the furnace, said furnace including a plurality of components and sensors associated with the components, the method comprising the steps of:

(a) performing an ignition sequence;

(b) choosing a burn sequence;

(c) determining if the burn pot temperature is equal to or exceeds a first preset threshold temperature, proceeding to (d) if said burn pot temperature is equal to or exceeds said first preset threshold temperature and proceeding to (g) if said burn pot temperature is not equal to or does not exceed said first preset threshold temperature;

(d) determining if said burn pot temperature is equal to or less than a second preset threshold temperature and proceeding to (e) if said burn pot temperature is equal to or less than said second preset threshold temperature and proceeding to continue determining if said burn pot temperature is equal to or less than said second preset threshold temperature;

(e) activating the fuel stirrer, waiting a predetermined time and then determining if said burn pot temperature is equal to or exceeds said first preset threshold temperature and proceeding to (d) if said burn pot temperature is equal to or exceeds said first preset threshold temperature and proceeding to (f) if said burn pot temperature is equal to or less than a third preset threshold temperature;

(f) providing a dosing of fuel, waiting a predetermined time and then determining if said burn pot temperature is equal to or exceeds said first preset threshold temperature and proceeding to (d) if said burn pot temperature is equal to or exceeds said first preset threshold temperature and proceeding to (g) if said burn pot temperature is not equal to or does not exceed said first preset threshold temperature;

(g) activating said stirrer and determining if said stiffer was activated and if said stiffer was activated proceed to step (h), if said stiffer was not activated proceed to step (m);

(h) waiting a predetermined time and then determining if said burn pot temperature is equal to or exceeds said first preset threshold temperature and proceeding to (d) if said burn pot temperature is equal to or exceeds said first preset threshold temperature and proceeding to (i) if said burn pot temperature is not equal to or does not exceed said first preset threshold temperature;

(i) providing a dosing of fuel, waiting a predetermined time and then determining if said burn pot temperature is equal to or exceeds said first preset threshold temperature and proceeding to (d) if said burn pot temperature is equal to or exceeds said first preset threshold temperature and proceeding to (j) if said burn pot temperature is not equal to or does not exceed said first preset threshold temperature;

(j) determining if this is the first time said computer controller has reached step (i) and proceeding to step (g) if this is the first time said computer controller has reached step (i) and proceeding to step (k) if this is not the first time the computer controller has reached step (i);

(k) activating the igniter and fan, waiting a predetermined time and then determining if the burn pot temperature is equal to or exceeds a fourth preset temperature and proceeding to step (c) if the burn pot temperature is equal to or exceeds said fourth preset temperature and proceeding to step (l) if said burn pot temperature is not equal to or does not exceed said fourth preset temperature;

(l) turning off said igniter, activating a no combustion alarm and deactivating said furnace;

(m) activating said stirrer and determining if said stiffer was activated, if said stiffer was activated proceed to step (h), if said stirrer was not activated proceed to step (n); and (n) activating the fuel stir alarm and deactivating said furnace.

* * * * *